US006242155B1

(12) United States Patent
Yamasaki et al.

(10) Patent No.: US 6,242,155 B1
(45) Date of Patent: Jun. 5, 2001

(54) METHOD OF MAKING LITHOGRAPHIC PRINTING PLATE AND PHOTOPOLYMER COMPOSITION

(75) Inventors: Sumiaki Yamasaki; Tadahiro Sorori, both of Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/374,507

(22) Filed: Aug. 16, 1999

(30) Foreign Application Priority Data

Aug. 14, 1998 (JP) ..... 10-229783

(51) Int. Cl.[7] ..... G03C 1/73
(52) U.S. Cl. ..... 430/270.1; 430/944; 430/964
(58) Field of Search ..... 430/302, 270.1, 430/944, 945, 964

(56) References Cited

U.S. PATENT DOCUMENTS

| | | | | |
|---|---|---|---|---|
| 3,706,276 | * | 12/1972 | Yamada et al. | 101/453 |
| 3,914,194 | * | 10/1975 | Smith | 260/18 |
| 4,081,572 | | 3/1978 | Pacansky | 427/53 |
| 4,946,761 | * | 8/1990 | Maemoto | 430/270 |
| 5,171,655 | * | 12/1992 | Aoshima | 430/138 |
| 5,235,015 | * | 8/1993 | Ali et al. | 528/304 |
| 5,417,164 | * | 5/1995 | Nishida et al. | 101/453 |
| 5,466,557 | * | 11/1995 | Haley et al. | 430/278 |
| 5,919,601 | * | 7/1999 | Nguyen et al. | 430/278.1 |
| 5,994,023 | * | 11/1999 | Van Damme et al. | 430/176 |
| 6,165,679 | * | 12/2000 | Van Damme et al. | 430/270.1 |

FOREIGN PATENT DOCUMENTS

| | | | |
|---|---|---|---|
| 38 25738 | | 3/1989 | (DE) . |
| 652 483 | * | 5/1995 | (EP) . |
| 0 867 769 | | 9/1998 | (EP) . |
| 99 38705 | | 8/1999 | (WO) . |

OTHER PUBLICATIONS

S. Ege, Organic Chemistry, Second Edition. D.C. Heath and Company, Lexington, Massachusetts, 1989, p. 649.*

* cited by examiner

*Primary Examiner*—Janet Baxter
*Assistant Examiner*—Barbara Gilmore
(74) *Attorney, Agent, or Firm*—Burns, Doane, Swecker & Mathis, LLP

(57) ABSTRACT

A method of making a lithographic printing plate by forming images at the surface of a lithographic printing plate precursor by means of a thermal head, with the lithographic printing plate precursor having on a support a recording layer comprising a polymer having at least either carboxylic acid or carboxylate groups capable of causing thermal decarboxylation; and a photopolymer composition for recording by exposure to infrared laser beams, wherein a thermally decarboxylation-causing polymer and a photothermal converter are comprised.

1 Claim, No Drawings

METHOD OF MAKING LITHOGRAPHIC PRINTING PLATE AND PHOTOPOLYMER COMPOSITION

FIELD OF THE INVENTION

The present invention relates to a method of making a lithographic printing plate and a photopolymer composition. In particular, the invention is concerned with a method of making a lithographic printing plate by the use of a lithographic printing plate precursor which comprises a support and an ink-receptive recording layer (image forming layer) and enables the platemaking to be performed by scanning exposure based on digital signals without additional wet processing, and further with a photopolymer composition used for the lithographic printing plate precursor.

BACKGROUND OF THE INVENTION

In general, the lithographic printing plate is constituted of a lipophilic imaging area to receive ink in the printing step and a hydrophilic non-imaging area to receive dampening water applied thereto prior to the inking step. For making such a lithographic printing plate, a presensitized plate (abbreviated as "PS plate" hereinafter) comprising a hydrophilic support and a ink-receptive photopolymer layer provided thereon has been widely used as a lithographic printing plate precursor. In a conventional method adopted therein for making the intended printing plate, mask exposure is generally carried out via a lith film, and then the non-imaging area is dissolved and removed with a developer.

In recent years, the technology to digitize image information has been widely spread, wherein the image information is electronically processed, stored and outputted by the use of a computer. And a variety of new image-output systems which can keep up with such digitization technology have become practical. Under these circumstances, it has been anxiously awaited to develop the computer-to-plate technology which enables the direct platemaking to be performed by scanning highly directional actinic rays, such as laser beams, corresponding to the digitized image information, but not using a lith film. And the production of printing plate precursors suitable for such technology has been one of important technical problems.

On the other hand, the conventional process of making a printing plate by the use of a PS plate necessitates a step of removing the non-imaging area by dissolution after exposure and, in general, further requires an after-processing step of washing the development-processed printing plate with wash water, a rinsing solution containing a surfactant or a desensitizing solution containing gum arabic and a starch derivative. Such an additional wet processing requirement has been recognized as leaving room for improvement. Lately in particular, consideration of global environment has been a matter of great concern of the whole industrial world. From the viewpoints of friendliness to the environment and streamlining the platemaking process accompanied by the digitization of image information, it has been desired more strongly than ever to render the processing steps for platemaking simple, dry or unnecessary.

With respect to the method of making a printing plate by means of scanning exposure, the utilization of actinic rays having high energy density, such as electron beams and high-output laser, has been proposed in addition to the utilization of a high speed photosensitive material. In recent years, it has become possible to get high-output solid laser devices, such as a semiconductor laser device and a YAG laser device, at low prices. As a result, the bright future of computer-to-plate systems utilizing such solid laser devices has come to be understood. The characteristic of high energy density exposure systems consists in that various phenomena, other than the photo reactions taking place in the low to medium energy density exposure-utilized photosensitive materials, can be applied to development. Specifically, not only a chemical change but also a structural change, such as change in phase or form, can be utilized for development. In general, such a high energy density exposure-utilized recording system is referred to as heat mode recording. This is because, in many high energy density exposure systems, it is believed that the energy of light absorbed by a photosensitive material is converted into heat, and the heat thus produced causes the intended development. The heat mode recording system has a great advantage in having potentialities for making the processing steps simple, dry or unnecessary. These potentialities are based on that the phenomena utilized for the image recording in a heat mode photosensitive material don't occur in a substantial sense under exposure to ordinary intensity of light or under temperatures of ordinary environment, so that no step for fixing images is required after exposure.

As a desirable method of making a lithographic printing plate on a basis of heat mode recording, a method proposal was advanced, wherein a precursor constituted of a water-receptive layer and an ink-receptive layer is subjected to heat mode exposure and only one layer of them is removed imagewise, thereby developing an imagewise difference between water-receptive and ink-receptive areas. This method can provide the precursor for printing plate showing relatively good printing properties in addition to the possibility of having scanning exposure suitability and rendering processing steps unnecessary or dry.

With respect to examples of such a lithographic printing plate precursor, JP-A-5-77574, JP-A-4-125189, U.S. Pat. No. 5,187,047 and JP-A-62-195646 (the term "JP-A" as used herein means an "unexamined published Japanese patent application") disclose using sulfonated polyolefin films as plate material requiring no development-processing and making printing plates through changes in hydrophilic properties of the film surface by thermal writing. More specifically, those systems form images through the desulfonation of sulfonic acid groups caused in the sensitive material surface by thermal writing.

In addition, U.S. Pat. No. 4,081,572 discloses the method of forming images through the dehydration ring closure caused in the polymers having carboxylic acid groups by exposure to heat or laser beams.

All those plate materials are hydrophilic films before exposure, but can be converted into hydrophobic ones by exposure. In other words, they are examples of the so-called polarity conversion negative press plate. The characteristic thereof is no need for development-processing.

However, the plate materials used in those conventional arts are lacking in thermal reactivity, so that it takes a long time to form images therein due to low sensitivity. Further, those materials have small discrimination between hydrophilic and hydrophobic areas, so that the printing plates made therefrom have nothing but insufficient water-receptivity or low image strength. In other words, sensitive materials which can afford satisfying sensitivity, scum resistance and press life cannot be obtained by those conventional arts.

SUMMARY OF THE INVENTION

Therefore, an object of the invention is to provide a lithographic printing plate to be made by short scanning exposure, or by writing with low-energy heat mode exposure, and ensuring excellent image-area strength and scum resistance in the lithographic printing plate made.

Another object of the invention is to provide a lithographic printing plate excellent in image-area strength and scum resistance by the use of a lithographic printing plate precursor which has excellent storage stability as well as high suitability for low-energy heat mode exposure, but does not necessarily require development-processing.

As a result of our intensive research for solving the problems of the conventional arts, it has been found that a lithographic printing plate precursor suitable for making a lithographic printing plate by heat mode exposure can be obtained by introducing therein a recording layer comprising a photothermal converter and a polymer containing functional groups having excellent thermal reactivity and causing decarboxylation by heating, thereby achieving the present invention.

More specifically, the objects of the invention are attained by the following embodiments (1) to (3):

(1) A method of making a lithographic printing plate by exposing a lithographic printing plate precursor to infrared laser beams to form images at the surface thereof, with the lithographic printing plate precursor being provided with a recording layer comprising a photothermal converter and a polymer having at least either carboxylic acid or carboxylate groups capable of causing thermal decarboxylation.

(2) A method of making a lithographic printing plate by forming images at the surface of a lithographic printing plate precursor by means of a thermal head, with the lithographic printing plate precursor being provided with a recording layer comprising a polymer having at least either carboxylic acid or carboxylate groups capable of causing thermal decarboxylation.

(3) A photopolymer composition for recording images by exposure to infrared laser beams, with the composition comprising a photothermal converter and a thermal decarboxylation-causing polymer that comprises at least either constitutional repeating units represented by the following formula (1) or constitutional repeating units represented by the following formula (2):

(1)

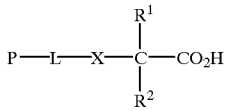

(2)

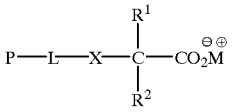

wherein X represents a group 4, 5 or 6 element, an oxide thereof, a sulfide thereof, a selenide thereof or a telluride thereof; P represents a repeating unit constituting the polymer main chain; —L— represents a divalent linkage group; $R^1$ and $R^2$, which are the same or different, each represent a monovalent group; and M represents an alkali metal, an alkaline earth metal or an onium.

DETAILED DESCRIPTION OF THE INVENTION

The invention is described below in detail.

The polymer used in the present image formation layer has no particular restrictions, provided that it has at least either carboxylic acid or carboxylate groups capable of causing thermal decarboxylation. Preferably, the polymer used in the invention is either a polymer comprising constitutional repeating units represented by the following formula (1) or a polymer comprising constitutional repeating units represented by the following formula (2), or a mixture thereof:

(1)

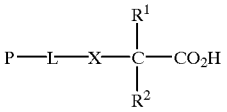

(2)

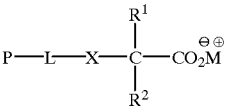

wherein X represents a group 4, 5 or 6 element, an oxide thereof, a sulfide thereof, a selenide thereof or a telluride thereof; P represents a repeating unit constituting the polymer main chain; —L— represents a divalent linkage group; $R^1$ and $R^2$, which are the same or different, each represents a hydrogen atom or a monovalent group; and M represents an alkali metal, an alkaline earth metal or an onium.

Specific examples of $R^1$ and $R^2$ include a hydrogen atom and monovalent groups constituted of nonmetal atoms, and preferred examples of the monovalent groups include a halogen atom (F, Br, Cl, I), a hydroxyl group, an alkoxy group, an aryloxy group, a mercapto group, an alkylthio group, an arylthio group, an alkyldithio group, an aryldithio group, an amino group, an N-alkylamino group, an N,N-diarylamino group, an N-alkyl-N-arylamino group, an acyloxy group, a carbamoyloxy group, an N-alkylcarbamoyloxy group, an N-arylcarbamoyloxy group, an N,N-dialkylcarbamoyloxy group, an N,N-diarylcarbamoyloxy group, an N-alkyl-N-arylcarbamoyloxy group, an alkylsulfoxy group, an arylsulfoxy group, an acylthio group, an acylamino group, an N-alkylacylamino group, an N-acrylacylamino group, a ureido group, an N'-alkylureido group, an N',N'-dialkylureido group, an N'-arylureido group, an N',N'-diarylureido group, an N'-alkyl-N'-arylureido group, an N-alkylureido group, an N-arylureido group, an N'-alkyl-N-alkylureido group, an N'-alkyl-N-arylureido group, an N',N'-dialkyl-N-alkylureido group, N',N'-dialkyl-N-arylureido group, an N'-aryl-N-alkylureido group, an N'-aryl-N-arylureido group, an N',N'-diaryl-N-alkylureido group, an N',N'-diaryl-N-arylureido group, an N'-alkyl-N'-aryl-N-alkylureido group, an N'-alkyl-N'-aryl-N-arylureido group, an alkoxycarbonylamino group, an aryloxycarbonylamino group, an N-alkyl-N-alkoxycarbonylamino group, an N-alkyl-N-aryloxycarbonylamino group, an N-aryl-N-alkoxycarbonylamino group, an N-aryl-N-aryloxycarbonylamino group, a formyl group, an acyl group, a carboxyl group, an alkoxycarbonyl group, an aryloxycarbonyl group, a carbamoyl group, an N-alkylcarbamoyl group, an N-dialkylcarbamoyl group, an N-arylcarbamoyl group, an N,N-diarylcarbamoyl group, an N-alkyl-N-arylcarbamoyl group, an alkylsulfinyl group, an arylsulfinyl group, an alkylsulfonyl group, an arylsulfonyl group, a sulfo group (—$SO_3H$) and a conjugate base group thereof (hereinafter referred to as "a sulfonato group"), an alkoxysulfonyl group, an arylsulfonyl group, a sulfinamoyl group, an N-alkylsulfinamoyl group, an N,N-dialkylsulfinamoyl group, an N-arylsulfinamoyl group, an N,N-diarylsulfinamoyl group, an N-alkyl-N-arylsulfinamoyl group, a sulfamoyl group, an N-alkylsulfamoyl group, N,N-dialkylsulfamoyl group, an N-arylsulfamoyl group, an N,N-diarylsulfamoyl group, an N-alkyl-N-arylsulfamoyl group, a phosphono group (—$PO_3H_2$) and a conjugate base group thereof (hereinafter referred to as "a phosphonato group"), a dialkylphosphono group (—$PO_3(alkyl)_2$), a diarylphosphono group (—$PO_3(alkyl)_2$), an alkylarylphosphono group (—$PO_3$(alkyl) (aryl)), a monoalkylphosphono group (—$PO_3H$(alkyl)) and a conjugate base group thereof (hereinafter referred to as "an alkylphosphonato group"), a monoarylphosphono group (—$PO_3H$(aryl)) and a conjugate base group thereof (hereinafter referred to as "an arylphosphonato group"), a phosphonoxy group (—$OPO_3H_2$) and a conjugate base group thereof (hereinafter referred to as "a phosphonatoxy group"), a dialkylphosphonoxy group (—$OPO_3(alkyl)_2$), a diarylphosphonoxy group (—$OPO_3(aryl)_2$), an alkylarylphosphonoxy group (—$OPO_3$ (alkyl) (aryl)), a monoalkylphosphonoxy group (—$OPO_3H$ (alkyl)) and a conjugate base group thereof (hereinafter referred to as "an alkylphosphonatoxy group"), a monoarylphosphonoxy group (—$OPO_3H$(aryl)) and a conjugate base group thereof (hereinafter referred to as "an arylphosphonatoxy group), a cyano group, a nitro group, an aryl group, an alkenyl group and an alkynyl group.

Among the above-described specific examples of $R^1$ and $R^2$ more preferred are a hydrogen atom, an alkoxy group, an amino group, an aryl group and an alkyl group, and the specific examples of the alkyl group include straight-chain, branched and cyclic alkyl groups containing 1 to 20 carbon atoms, such as methyl, ethyl, propyl, butyl, pentyl, hexyl, heptyl, octyl, nonyl, decyl, undecyl, dodecyl, tridecyl, hexadecyl, octadecyl, eicosyl, ispropyl, isobutyl, s-butyl, t-butyl, isopentyl, neopentyl, 1-methylbutyl, isohexyl, 2-ethylhexyl, 2-methylhexyl, cyclohexyl, cyclopentyl and 2-norbornyl groups. Of these groups, the straight-chain alkyl groups containing 1 to 12 carbon atoms, the branched alkyl groups containing 3 to 12 carbon atoms and the cycloalkyl groups containing 5 to 10 carbon atoms are particularly preferred over the others. Further, these alkyl groups may have one or more substituents.

As the substituents for the substituted alkyl groups, monovalent groups constituted of nonmetal atoms are used. Preferred examples include a halogen atom (F, Br, Cl, I), a hydroxyl group, an alkoxy group, an aryloxy group, a mercapto group, an alkylthio group, an arylthio group, an alkyldithio group, an aryldithio group, an amino group, an N-alkylamino group, an N,N-diarylamino group, an N-alkyl-N-arylamino group, an acyloxy group, a carbamoyloxy group, an N-alkylcarbamoyloxy group, an N-arylcarbamoyloxy group, an N,N-dialkylcarbamoyloxy group, an N,N-diarylcarbamoyloxy group, an N-alkyl-N-arylcarbamoyloxy group, an alkylsulfoxy group, an arylsulfoxy group, an acylthio group, an acylamino group, an N-alkylacylamino group, an N-acrylacylamino group, an ureido group, an N'-alkylureido group, an N',N'-dialkylureido group, an N'-arylureido group, an N',N'-diarylureido group, an N'-alkyl-N'-arylureido group, an N-alkylureido group, an N-arylureido group, an N'-alkyl-N-alkylureido group, an N'-alkyl-N-arylureido group, an N',N'-dialkyl-N-alkylureido group, N',N'-dialkyl-N-arylureido group, an N'-aryl-N-alkylureido group, an N'-aryl-N-arylureido group, an N',N'-diaryl-N-alkylureido group, an N',N'-diaryl-N-arylureido group, an N'-alkyl-N'-aryl-N-alkylureido group, an N'-alkyl-N'-aryl-N-arylureido group, an alkoxycarbonylamino group, an aryloxycarbonylamino group, an N-alkyl-N-alkoxycarbonylamino group, an N-alkyl-N-aryloxycarbonylamino group, an N-aryl-N-alkoxycarbonylamino group, an N-aryl-N-aryloxycarbonylamino group, a formyl group, an acyl group, a carboxyl group, an alkoxycarbonyl group, an aryloxycarbonyl group, a carbamoyl group, an N-alkylcarbamoyl group, an N-dialkylcarbamoyl group, an N-arylcarbamoyl group, an N,N-diarylcarbamoyl group, an N-alkyl-N-arylcarbamoyl group, an alkylsulfinyl group, an arylsulfinyl group, an alkylsulfonyl group, an arylsulfonyl group, a sulfo group (—$SO_3H$) and a conjugate base group thereof (hereinafter referred to as "a sulfonato group"), an alkoxysulfonyl group, an arylsulfonyl group, a sulfinamoyl group, an N-alkylsulfinamoyl group, an N,N-dialkylsulfinamoyl group, an N-arylsulfinamoyl group, an N,N-diarylsulfinamoyl group, an N-alkyl-N-arylsulfinamoyl group, a sulfamoyl group, an N-alkylsufamoyl group, N,N-dialkylsulfamoyl group, an N-arylsulfamoyl group, an N,N-diarylsulfamoyl group, an N-alkyl-N-arylsulfamoyl group, a phosphono group (—$PO_3H_2$) and a conjugate base group thereof (hereinafter referred to as "a phosphonato group"), a dialkylphosphono group (—$PO_3(alkyl)_2$), a diarylphosphono group (—$PO_3(aryl)_2$), an alkylarylphosphono group (—$PO_3$(alkyl) (aryl)), a monoalkylphosphono group (—$PO_3H$(alkyl)) and a conjugate base group thereof (hereinafter referred to as "an alkylphosphonato group"), a monoarylphosphono group (—$PO_3H$(aryl)) and a conjugate base group thereof (hereinafter referred to as "an arylphosphonato group"), a phosphonoxy group (—$OPO_3H_2$) and a conjugate base group thereof (hereinafter referred to as "a phosphonatoxy group"), a dialkylphosphonoxy group (—$OPO_3(alkyl)_2$), a diarylphosphonoxy group (—$OPO_3(aryl)_2$), an alkylarylphosphonoxy group (—$OPO_3$(alkyl) (aryl)), a monoalkylphosphonoxy group (—$OPO_3H$(alkyl)) and a conjugate base group thereof (hereinafter referred to as "an alkylphosphonatoxy group"), a monoarylphosphonoxy group (—$OPO_3H$(aryl)) and a conjugate base group thereof (hereinafter referred to as "an arylphosphonatoxy group), a cyano group, a nitro group, an aryl group, an alkenyl group and an alkynyl group.

Examples of an alkyl moiety in those substituent groups include the alkyl groups recited above and those of an aryl moiety in those substituent groups include a phenyl group, a biphenyl group, a naphthyl group, a tolyl group, a xylyl group, a mesityl group, a cumenyl group, a chlorophenyl group, a bromophenyl group, a chloromethylphenyl group, a hydroxyphenyl group, a methoxyphenyl group, an ethoxyphenyl group, a phenoxyphenyl group, an acetoxyphenyl group, a benzoyloxyphenyl group, a methylthiophenyl group, a phenylthiophenyl group, a methylaminophenyl group, a dimethylaminophenyl group, an acetylaminophenyl group, a carboxyphenyl group, a methoxycarbonylphenyl group, an ethoxyphenylcarbonyl group, a phenoxycarbonylphenyl group, an N-phenylcarbamoylphenyl group, a phenyl group, a cyanophenyl group, a sulfophenyl group, a sulfonatophenyl group, a phosphonophenyl group and a phosphonatophenyl group. Examples of an alkenyl group include a vinyl group, a 1-propenyl group, a 1-butenyl group, a cinnamyl group and a 2-chloro-1-ethenyl group. Examples of an alkynyl group include an ethynyl group, a 1-propynyl group, a 1-butynyl group and a trimethylsilylethynyl group. As examples of $G^1$ in $G^1CO$— representing an acyl group, mention may be made of a hydrogen atom and the above-recited alkyl and aryl groups. Of those substituent groups, halogen atoms (F, Br, Cl, I), alkoxy groups, aryloxy groups, alkylthio groups, arylthio groups, N-alkylamino groups, N,N-dialkylamino group, acyloxy groups, N-alkylcarbamoyloxy groups, N-arylcarbamoyloxy group, acylamino groups, a formyl group, acyl groups, a carboxyl group, alkoxycarbonyl groups, aryloxycarbonyl groups, a carbamoyl group, N-alkylcarbamoyl groups, N,N-dialkylcarbamoyl groups, N-arylcarbamoyl groups, N-alkyl-N-arylcarbamoyl groups, a sulfo group, a sulfonato group, a sulfamoyl group, N-alkylsulfamoyl groups, N,N-dialkylsulfamoyl groups, N-arylsulfamoyl groups, N-alkyl-N-arylsulfamoyl groups, a phosphono group, a phosphonato group, dialkylphosphono groups, diarylphosphono groups, monoalkylphosphono groups, alkylphosphonato groups, monoarylphosphono groups, arylphosphonato groups, a phosphonoxy group, a phosphonatoxy group, aryl groups and alkenyl groups are much preferred over the others.

Further, the monovalent group as $R^1$ and $R^2$ each may be a substituted alkyl group. Examples of an alkylene moiety in such a substituted alkyl group include divalent organic residues formed by removing one hydrogen atom from each of the $C_{1-20}$ alkyl groups as recited above, preferably $C_{1-12}$ straight-chain alkylene groups, $C_{3-12}$ branched alkylene groups and $C_{5-10}$ cycloalkylene groups. Suitable examples of a substituted alkyl group formed by combining a substituent and an alkylene group include chloromethyl, bromomethyl, 2-chloroethyl, trifluoromethyl, methoxymethyl, methoxyethoxyethyl, allyloxymethyl, phenoxymethyl, methylthiomethyl, tolylthiomethyl, ethylaminoethyl, diethylaminopropyl, morpholinopropyl, acetyloxymethyl, benzoyloxymethyl, N-cyclohexylcarbamoyloxyethyl, N-phenylcarbamoyloxyethyl, acetylaminoethyl, N-ethylbenzoylaminopropyl, 2-hydroxyethyl, 2-hydroxypropyl, carboxypropyl, methoxycarbonylethyl, allyloxycarbonylbutyl, chlorophenoxycarbonylmethyl, carbamoylmethyl, N-methylcarbamoylethyl, N,N-dipropylcarbamoylmethyl, N-(methoxyphenyl)carbamoylethyl, N-methyl-N-(sulfophenyl)carbamoylmethyl, sulfobutyl, sulfonatobutyl, sulfamoylbutyl, N-ethylsulfamoylmethyl, N,N-dipropylsulfamoylpropyl, N-tolylsulfamoylpropyl, N-methyl-N-(phosphonophenyl)sulfamoyloctyl, phosphonobutyl, phosphonatohexyl, diethylphosphonobutyl, diphenylphosphono-propyl, methylphosphonobutyl, methylphosphonatobutyl, triphosphonohexyl, tolylphosphonatohexyl, phosphonoxypropyl, phosphonatooxybutyl, benzyl, phenetyl, α-methylbenzyl, 1-methyl-1-phenylethyl, p-methylbenzyl, cinnamyl, allyl, 1-propenylmethyl, 2-butenyl, 2-methylallyl, 2-methyl-propenylmethyl, 2-propenyl, 2-butynyl and 3-butynyl groups.

The aryl group as a monovalent group represented by $R^1$ and $R^2$ each includes a group having one benzene ring, a group in which two or three benzene rings are condensed, and a group in which a benzene ring and a 5-membered unsaturated ring are condensed. As examples of such a group, mention may be made of a phenyl group, a naphthyl group, an anthryl group, a phenanthryl group, an indenyl group, an acenaphthenyl group and a fluorenyl group. Of these groups, a phenyl group and a naphthyl group are preferred over the others. Besides the carbocyclic aryl groups as recited above, the aryl group can include heterocyclic aryl groups. In such heterocyclic aryl groups, 3 to 20 carbon atoms and 1 to 5 hetero atoms are contained, and further a benzene ring may be contained in a condensed state. Examples of such a heterocyclic aryl group include a pyridyl group, a furyl group, a quinolyl group, a benzofuryl group, a thioxanthone group and a carbazole group.

Those aryl groups each can have a monovalent nonmetal atomic group as substituent group on a ring-forming carbon atom. Suitable examples of such a substituent group include the alkyl groups as recited above, the substituted alkyl groups as recited above and the substituent groups present therein. As appropriate examples of such a substituted aryl group, mention may be made of biphenyl, tolyl, xylyl, mesityl, cumenyl, chlorophenyl, bromophenyl, fluorophenyl, chloromethylphenyl, trifluoromethylphenyl, hydroxyphenyl, methoxyphenyl, methoxyethoxyphenyl, allyloxyphenyl, phenoxyphenyl, methylthiophenyl, tolylthiophenyl, ethylaminophenyl, diethylaminophenyl, morpholinophenyl, acetyloxyphenyl, benzoyloxyphenyl, N-cyclohexylcarbamoyloxyphenyl, N-phenylcarbamoyloxyphenyl, acetylaminophenyl, N-methylbenzoylaminophenyl, carboxyphenyl, methoxycarbonyl-phenyl, allyloxycarbonylphenyl, chlorophenoxycarbonylphenyl, carbamoylphenyl, N-methylcarbamoylphenyl, N,N-dipropylcarbamoylphenyl, N-(methoxyphenyl)carbamoylphenyl, N-methyl-N-(sulfophenyl)carbamoylphenyl, sulfophenyl, sulfonatophenyl, sulfamoylphenyl, N-ethylsulfamoylphenyl, N,N-dipropylsulfamoylphenyl, N-tolylsulfamoylphenyl, N-methyl-N-(phosphonophenyl) sulfamoylphenyl, phosphonophenyl, phosphonatophenyl, diethylphosphonophenyl, diphenylphosphonophenyl, methylphosphonophenyl, methylphosphonatophenyl, tolylphosphonophenyl, tolylphosphonatophenyl, allylphenyl, 1-propenylmethylphenyl, 2-butenylphenyl, 2-methylallylphenyl, 2-methylpropenylphenyl, 2-propynylphenyl, 2-butynylphenyl and 3-butynylphenyl groups.

Suitable examples of —X— include —O—, —S—, Se—, —$NR^3$—, —CO—, —SO—, —$SO_2$—, and —PO—. Of these groups, —CO—, —SO— and —$SO_2$— are preferred in particular over the others from the viewpoint of thermal reactivity.

The group appropriate for $R^3$ may be the same as or different from $R^1$ or $R^2$, and it can be selected from the groups recited above as examples of $R^1$ or $R^2$.

The divalent linkage group represented by L is constituted of 1 to 60 carbon atoms, 0 to 10 nitrogen atoms, 0 to 50 oxygen atoms, 1 to 100 hydrogen atoms and 0 to 20 sulfur atoms. Examples of such a divalent linkage group include groups formed by combining two or more of the following structural units:

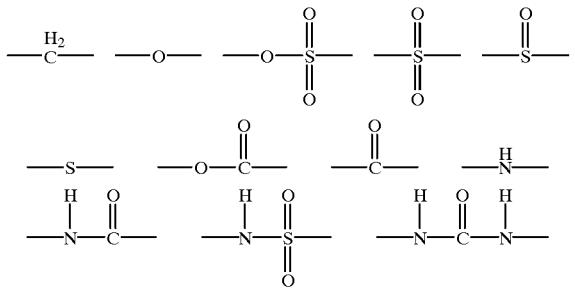

-continued

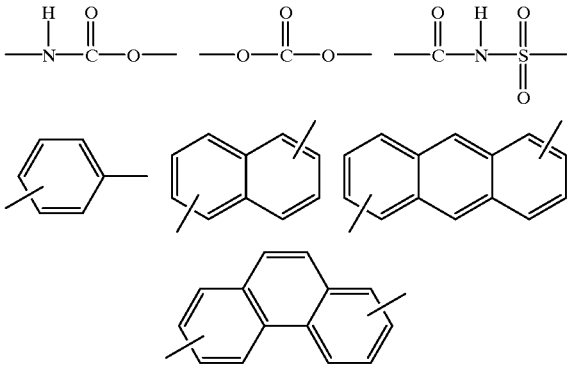

M has no particular restriction as far as it is a cation, but it is desirable for M to be a monovalent to tetravalent metal cation or an ammonium ion represented by the following formula (3):

(3)

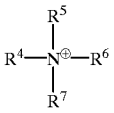

wherein $R^4$, $R^5$, $R^6$ and $R^7$, which may be the same or different, each represent a monovalent group.

Examples of a monovalent to tetravalent metal cation represented by M include $Li^+$, $Na^+$, $K^+$, $Rb^+$, $Cs^+$, $Fr^+$, $Be^{2+}$, $Mg^{2+}$, $Ca^{2+}$, $Sr^{2+}$, $Ba^{2+}$, $Ra^{2+}$, $Cu^+$, $Cu^{2+}$, $Ag^+$, $Zn^{2+}$, $Al^{3+}$, $Fe^{2+}$, $Fe^{3+}$, $Co^{2+}$, $Ni^{2+}$, $Ti^{4+}$, and $Zr^{4+}$. Of these cations, $Li^+$, $Na^+$, $K^+$, $Rb^+$, $Cs^+$, $Fr^+$, $Cu^+$ and $Ag^+$ are preferred over the others.

Examples of groups represented by $R^4$ to $R^7$ in the ammonium ion of formula (3) include the same groups as recited as examples of $R^1$ to $R^3$. The following are examples of an ammonium ion represented by formula (3):

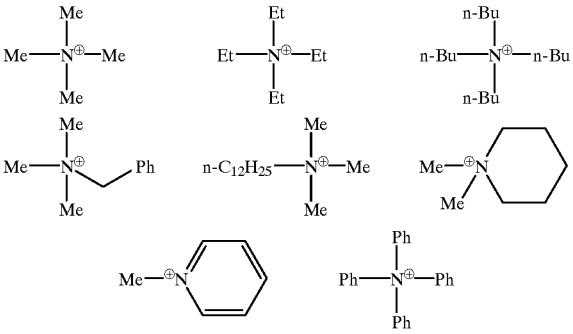

The repeating units constituting the polymer main chain, which are represented by P in formulae (1) and (2), can be selected from the following structural moieties:

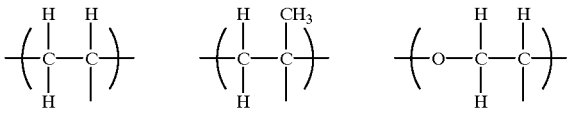

-continued

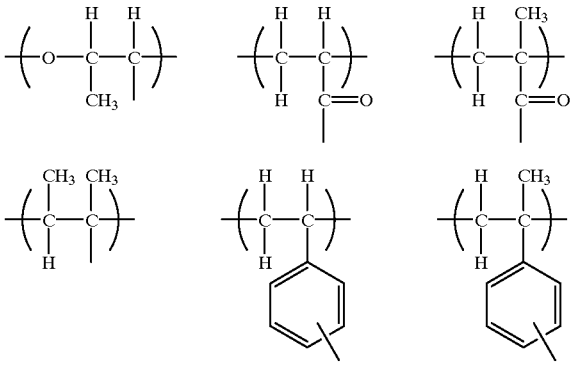

Specific examples of monomers having at least either carboxylic acid groups or carboxylate groups are shown below.

(1)

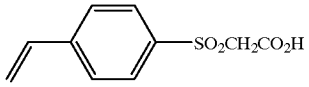

(2)

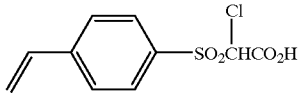

(3)

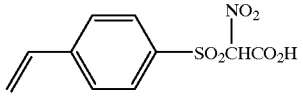

(4)

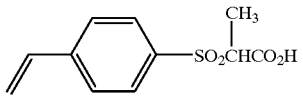

(5)

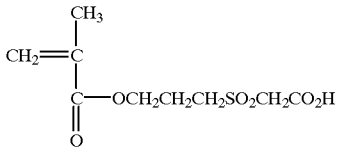

(6)

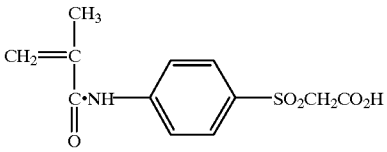

(7)

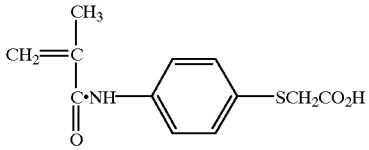

(8)

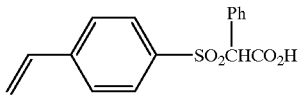

-continued (9)

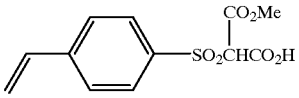

(10)

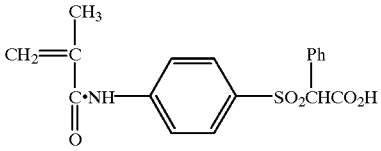

(11)

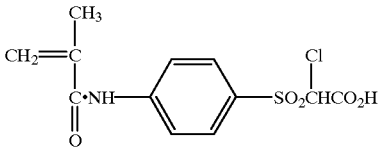

(12)

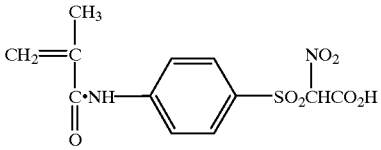

(13)

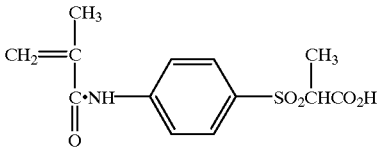

(14)

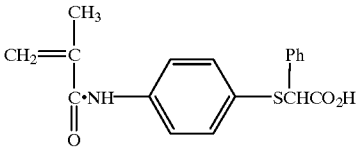

(15)

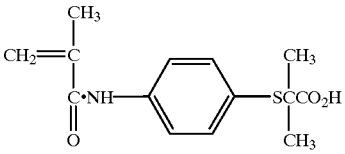

(16)

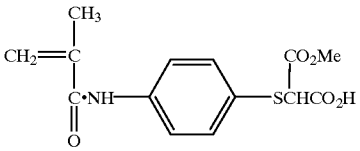

(17)

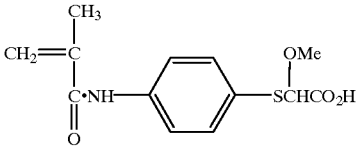

-continued (18)

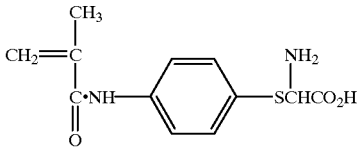

(19)

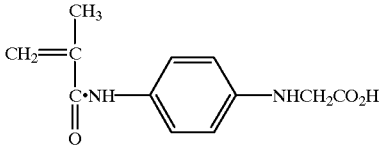

(20)

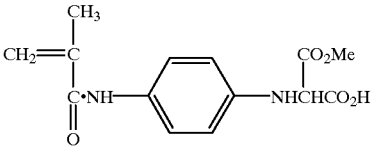

(21)

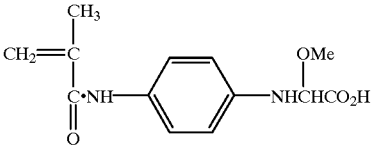

(22)

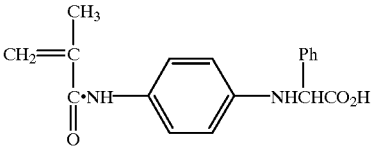

(23)

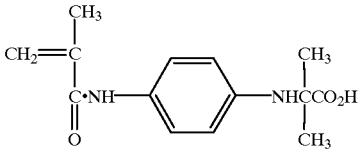

(24)

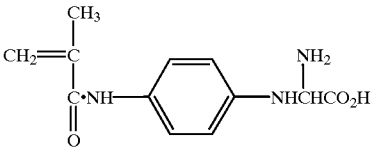

The present polymer having at least either carboxylic acid groups or carboxylate groups may be a homopolymer constituted of the same repeating units of formula (1) or (2) or a copolymer constituted of two or more kinds of repeating units selected from those represented by formulae (1) and (2). Further, the present polymer may be a copolymer having different constitutional repeating units derived from other monomers.

Examples of the other monomers usable in the invention include known monomers, such as acrylic acid esters, methacrylic acid esters, acrylamides, methacrylamides, vinyl esters, styrenes, acrylic acid, methacrylic acid, acrylonitrile, maleic anhydride and maleimide. By the use of such monomers as comonomers, various properties, including film formability, film strength, water wettability, hydrophobicity, solubility, reactivity and stability, can be improved.

Examples of acrylic acid esters include methyl acrylate, ethyl acrylate, (n- or i-)propyl acrylate, (n-, i-, sec- or t-)butyl acrylate, amyl acrylate, 2-ethylhexyl acrylate, dodecyl acrylate, chloroethyl acrylate, 2-hydroxyethyl acrylate, 2-hydroxypropyl acrylate, 2-hydroxypentyl acrylate, cyclohexyl acrylate, allyl acrylate, trimethylolpropane monoacrylate, pentaerythrithol monoacrylate, benzyl acrylate, methoxybenzyl acrylate, chlorobenzyl acrylate, hydroxybenzyl acrylate, hydroxyphenetyl acrylate, dihydroxyphenetyl acrylate, furfuryl acrylate, tetrahydrofurfuryl acrylate, phenyl acrylate, hydroxyphenyl acrylate, chlorophenyl acrylate, sulfamoylphenyl acrylate and 2-(hydroxyphenylcarbonyloxy)ethyl acrylate.

Examples of methacrylic acid esters include methyl methacrylate, ethyl methacrylate, (n- or i-)propyl methacrylate, (n-, i-, sec- or t-)butyl methacrylate, amyl methacrylate, 2-ethylhexylmethacrylate, dodecylmethacrylate, chloroethyl methacrylate, 2-hydroxyethylmethacrylate, 2-hydroxypropyl methacrylate, 2-hydroxypentyl methacrylate, cyclohexyl methacrylate, allyl methacrylate, trimethylolpropane monomethacrylate, pentaerythritol monomethacrylate, benzyl methacrylate, methoxybenzyl methacrylate, chlorobenzyl methacrylate, hydroxybenzyl methacrylate, hydroxyphenetyl methacrylate, dihydroxyphenetyl methacrylate, furfuryl methacrylate, tetrahydrofurfuryl methacrylate, phenyl methacrylate, hydroxyphenyl methacrylate, chlorophenyl methacrylate, sulfamoylphenyl methacrylate and 2-(hydroxyphenylcarbonyloxy)ethyl methacrylate.

Examples of acrylamides include acrylamide, N-methylacrylamide, N-ethylacrylamide, N-propylacrylamide, N-butylacrylamide, N-benzylacrylamide, N-hydroxyethyl-acrylamide, N-phenylacrylamide, N-tolylacrylamide, N-(hydroxyphenyl)acrylamide, N-(sulfamoylphenyl) acrylamide, N-(phenylsulfonyl)acrylamide, N-(tolylsulfonyl)acrylamide, N,N-dimethylacrylamide, N-methyl-N-phenylacrylamide and N-hydroxyethyl-N-methylacrylamide.

Examples of methacrylamides include methacrylamide, N-methylmethacrylamide, N-ethylmethacrylamide, N-propylmethacrylamide, N-butylmethacrylamide, N-benzylmethacrylamide, N-hydroxyethylmethacrylamide, N-phenylmethacrylamide, N-tolylmethacrylamide, N-(hydroxyphenyl)-methacrylamide, N-(sulfamoylphenyl) methacrylamide, N-(phenylsulfonyl)methacrylamide, N-(tolylsulfonyl)methacrylamide, N,N-dimethylmethacrylamide, N-methyl-N-phenylmethacrylamide and N-hydroxyethyl-N-methylmethacrylamide.

Examples of vinyl esters include vinyl acetate, vinyl butyrate and vinyl benzoate.

Examples of styrenes include styrene, methylstyrene, dimethylstyrene, trimethylstyrene, ethyl styrene, propylstyrene, cyclohexylstyrene, chloromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene and carboxystyrene.

In synthesizing copolymers according to the invention, those monomers are used in their respective proportions sufficient for improvements in various physical properties. When other monomers are used in too large proportions, the function of the present monomer containing a carboxylic acid group or a carboxylate group becomes insufficient. Therefore, it is desirable that the total proportion of the other monomers be at most 80 weight %, preferably at most 50 weight %.

Examples of a polymer according to the invention, which has at least either carboxylic acid or carboxylate groups capable of causing thermal decarboxylation, are illustrated below:

(P-1)

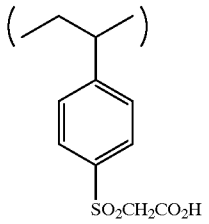

(P-2)

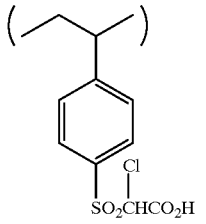

(P-3)

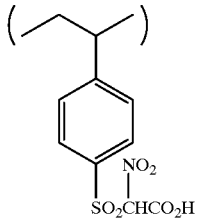

(P-4)

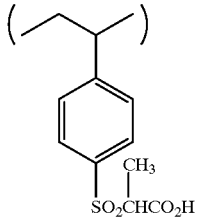

(P-5)

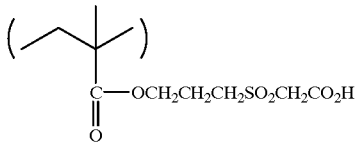

(P-6)

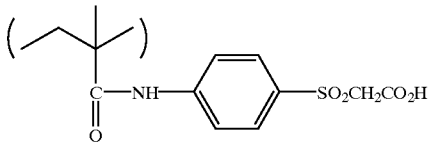

(P-7)

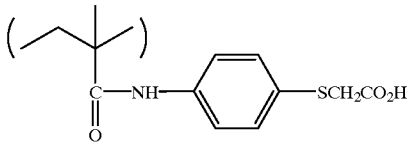

-continued
(P-8)
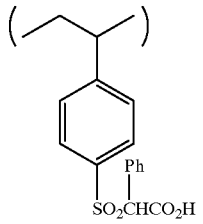
(P-9)
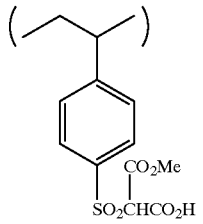
(P-10)
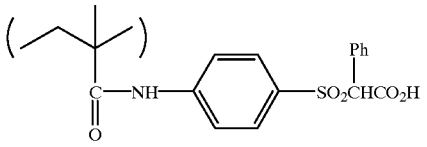
(P-11)
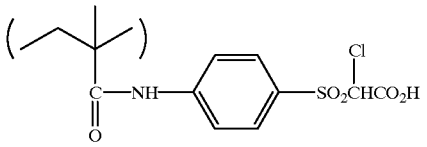
(P-12)
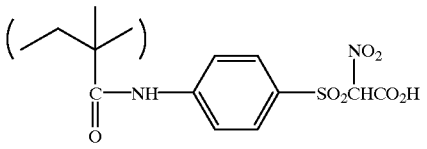
(P-13)
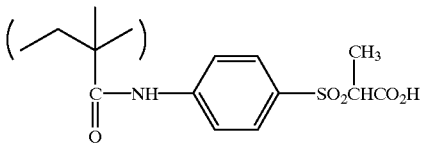
(P-14)
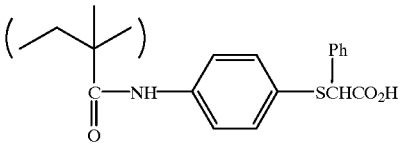
(P-15)
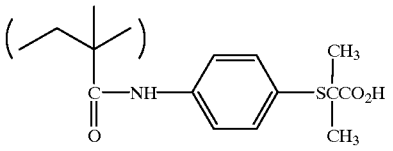
-continued
(P-16)
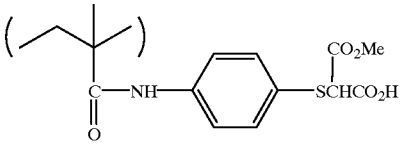
(P-17)
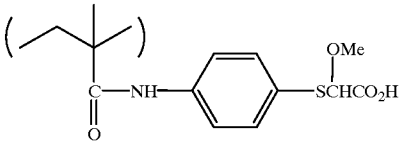
(P-18)
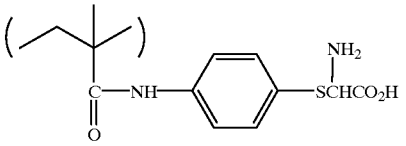
(P-19)
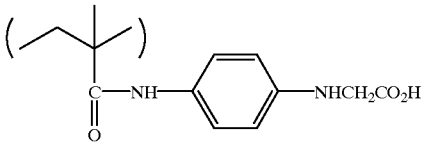
(P-20)
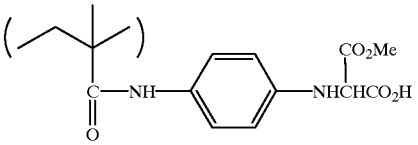
(P-21)
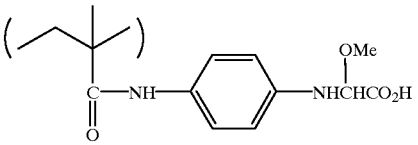
(P-22)
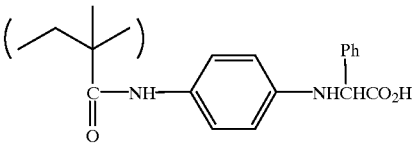
(P-23)
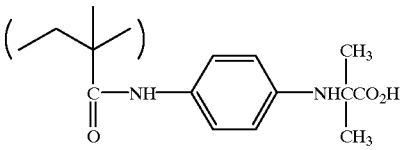
(P-24)
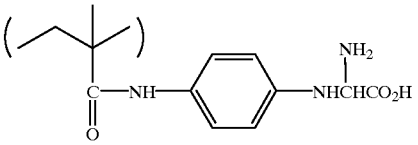

-continued
(P-25)
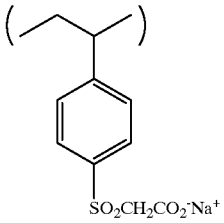
(P-26)
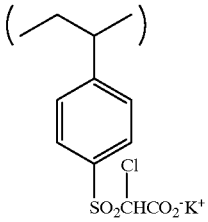
(P-27)
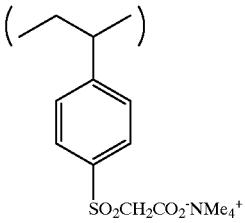
(P-28)
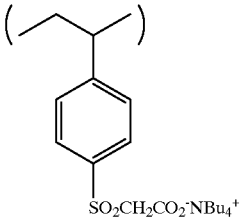
(P-29)
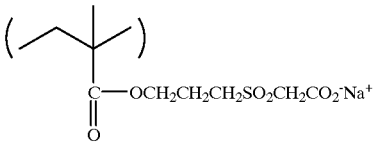
(P-30)
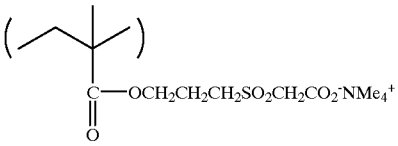
(P-31)
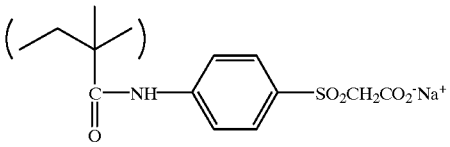
(P-32)
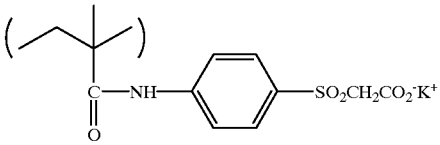
-continued
(P-33)
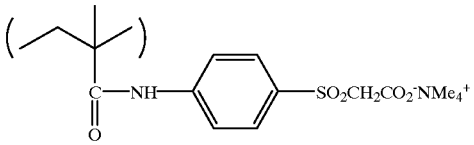
(P-34)
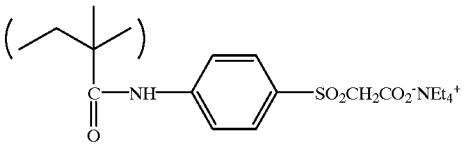
(P-35)
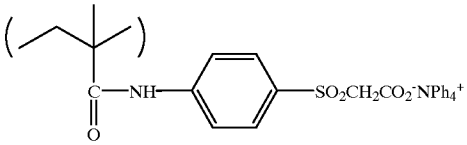
(P-36)
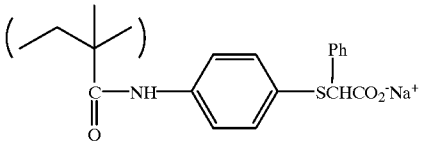
(P-37)
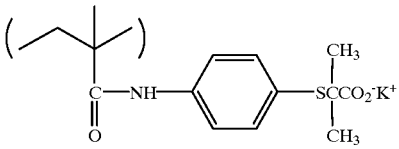
(P-38)
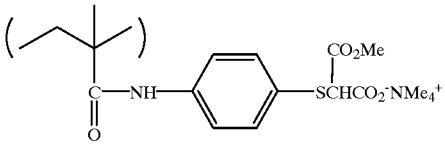
(P-39)
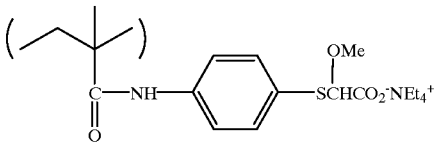
(P-40)
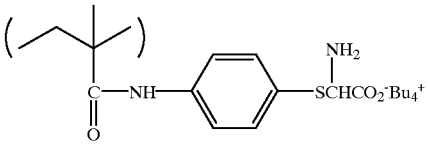
(P-41)
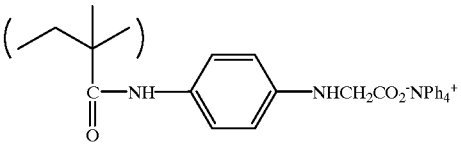

-continued
(P-42)
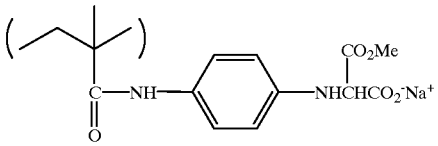
(P-43)
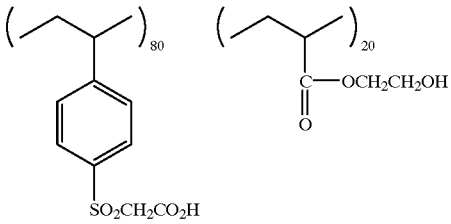
(P-44)
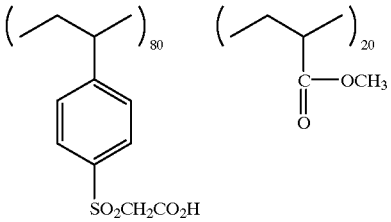
(P-45)
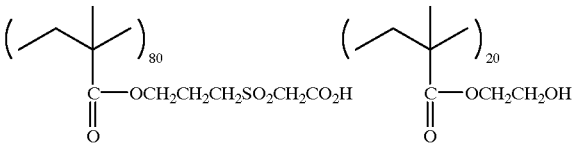
(P-46)
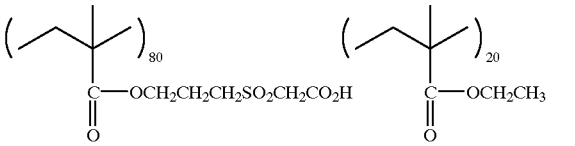
(P-47)
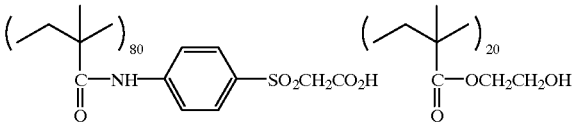
(P-48)
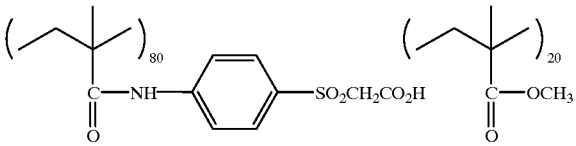
(P-49)
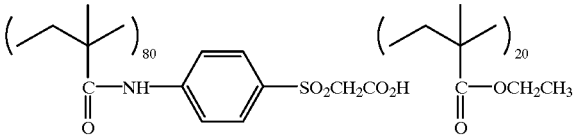
-continued
(P-50)
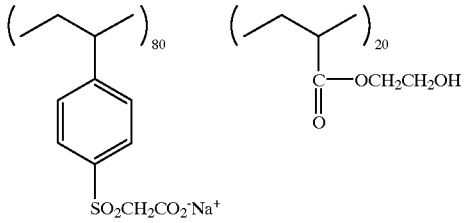
(P-51)
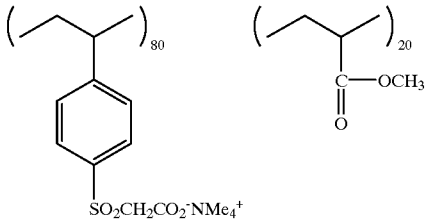
(P-52)
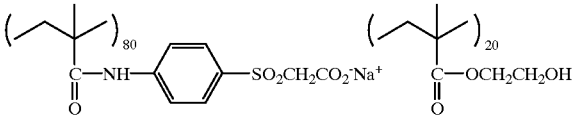
(P-53)
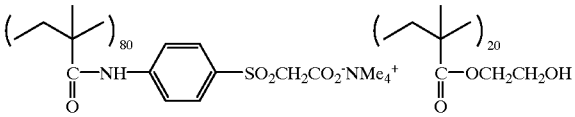
(P-54)
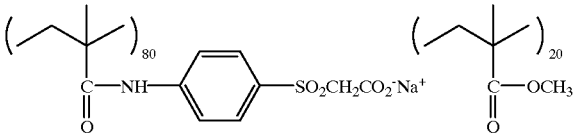
(P-55)
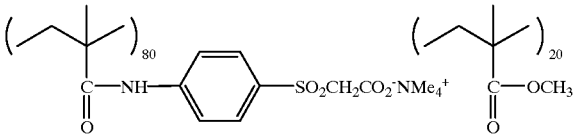
(P-56)
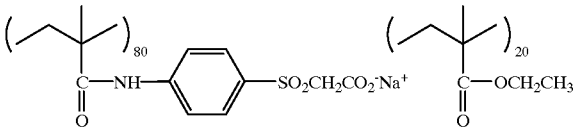
(P-57)
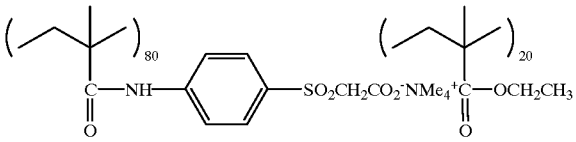

Synthesis Example

Synthesis of Monomer (1)

Into a 3-liter three-necked flask were charged 1,000 ml of water, 100 g of p-styrenesulfonyl chloride, 126 g of sodium sulfite, 106 g of sodium carbonate and hydroquinone in a catalytic amount. These components were then heated with stirring with the internal temperature being kept at 45° C. After 1 hour, 174 g of sodium chloroacetate and 12 g of potassium iodide were added to the mixture. The internal temperature was raised to 70° C. where the mixture was then stirred for 5 hours. After reaction, the reaction mixture was allowed to cool to room temperature. Concentrated hydrochloric acid was then added dropwise to the reaction mixture over an ice bath until the pH value of the solution reached 1. As a result, precipitation of a solid matter was observed. The precipitate was filtered off, thoroughly washed with water, and then dried to obtain 95 g of a white powder. The product showed a purity of 99% as determined by HPLC.

Synthesis of Monomers (2) to (4), (8) and (9)

Monomers (2) to (4), (8) and (9) were prepared in the same manner as in the synthesis of Monomer (1) except that the corresponding p-styrenesulfonyl chloride and sodium chloroacetate were used, respectively. The purity of these monomers as determined by HPLC are listed below.

| Monomer No. | Purity |
|---|---|
| (2) | 98% |
| (3) | 97% |
| (4) | 97% |
| (8) | 99% |
| (9) | 98% |

Synthesis of Monomer (5)

Into a 3-liter three-necked flask were charged 1,000 ml of water, 113 g of 3-methacryloxypropylsulfonyl chloride, 126 g of sodium sulfite, 106 g of sodium carbonate and hydroquinone in a catalytic amount. These components were then heated with stirring with the internal temperature being kept at 45° C. After 1 hour, 174 g of sodium chloroacetate and 12 g of potassium iodide were added to the mixture. The internal temperature was raised to 70° C. where the mixture was then stirred for 5 hours. After reaction, the reaction mixture was allowed to cool to room temperature. Concentrated hydrochloric acid was then added dropwise to the reaction mixture over an ice bath until the pH value of the solution reached 1. As a result, precipitation of a solid matter was observed. The precipitate was filtered off, thoroughly washed with water, and then dried to obtain 98 g of a white powder of Monomer (5). The product showed a purity of 98% as determined by HPLC.

Synthesis of Monomer (6)

Into a 2-liter three-necked flask were charged 1,600 ml of water, 250 g of N-acetylsulfanilyl chloride, 270 g of sodium sulfite and 227 g of sodium carbonate. These components were then heated with stirring with the internal temperature being kept at 45° C. After 1 hour, 250 g of sodium chloroacetate and 27 g of potassium iodide were added to the mixture. The internal temperature was raised to 70° C. where the mixture was then stirred for 5 hours. After reaction, the reaction mixture was allowed to cool to room temperature. Concentrated hydrochloric acid was then added dropwise to the reaction mixture over an ice bath until the pH value of the solution reached 1. As a result, precipitation of a solid matter was observed. The precipitate was filtered off, thoroughly washed with water, and then dried to obtain 250 g of N-acetylsulfanylacetic acid(white solid matter).

Subsequently, into a 2-liter three-necked flask were charged 1,000 ml of water and 250 g of N-acetylsulfanylacetic acid thus obtained. To the mixture was then slowly added dropwise 105 of concentrated sulfuric acid. After the dropwise addition, the reaction mixture was heated with stirring under reflux for 4 hours. Thereafter, the reaction mixture was allowed to cool to room temperature where water was then removed therefrom. The residue was then thoroughly washed with acetonitrile to obtain 200 g of p-aminobenzensulfonyl acetosulfate (white solid matter).

Subsequently, into a 3-liter three-necked flask were charged 1,500 ml of water and 200 g of p-aminobenzenesulfonyl acetosulfate thus obtained. 90 g of sodium hydroxide was then added to the reaction mixture over ice bath. Thereafter, to the reaction mixture was slowly added dropwise 200 g of methacrylic acid chloride. After the dropwise addition, the reaction mixture was stirred at room temperature for 5 hours. After reaction, concentrated hydrochloric acid was added dropwise to the reaction solution over an ice bath until the pH value of the reaction solution reached 1. The resulting precipitate was filtered off, and then thoroughly washed with water to obtain a white solid matter. The white solid matter thus obtained was then recrystallized from a mixture of methanol and water so that it was purified to obtain 210 g of Monomer (6) in the form of white solid matter (purity: 99% as determined by HPLC).

Synthesis of Monomers (10) to (13)

Monomers (10) to (13) were prepared in the same manner as in the synthesis of Monomer (6) except that the corresponding N-acetylsulfamyl chloride and sodium chloroacetate were used, respectively. The purity of these monomers as determined by HPLC are listed below.

| Monomer No. | Purity |
|---|---|
| (10) | 99% |
| (11) | 99% |
| (12) | 99% |
| (13) | 98% |

Synthesis of Monomer (7)

Into a 500 ml three-necked flask were charged 60 ml of water, 120 ml of methanol and 75 g of sodium hydroxide. 75 g of 4-aminothiphenol and 85 g of sodium chloroacetate were then slowly added to the mixture over an ice bath. Thereafter, the reaction mixture was allowed to cool to room temperature where it was then stirred for 6 hours. After reaction, concentrated hydrochloric acid was added dropwise to the reaction mixture over an ice bath until the pH value of the solution reached 1. As a result, precipitation of a solid matter was observed. The precipitate was filtered off, thoroughly washed with water, and then dried to obtain 95 g of 4-aminophenylsulfanylacetic acid (white powder).

Subsequently, into a 1-liter three-necked flask were charged 820 ml of water and 95 g of N-aminophenylsulfanylacetic acid thus obtained. To the mixture were then slowly added dropwise 62 g of sodium hydroxide and 93 g of methacryloyl chloride over an ice bath. Thereafter, the reaction mixture was allowed to cool to room temperature where it was then stirred for 6 hours. After reaction, concentrated hydrochloric acid was added dropwise to the reaction mixture until the pH value of the solution reached 1. As a result, precipitation of a solid matter was observed. The resulting precipitate was filtered off, and then thoroughly washed with water to obtain a white solid matter. The white solid matter thus obtained was then recrystallized from a mixture of ethanol and water so that it was purified to obtain 98 g of Monomer (7) in the form of white solid matter (purity: 99% as determined by HPLC).

Synthesis of Monomers (14) to (18)

Monomers (14) to (18) were prepared in the same manner as in the synthesis of Monomer (7) except that the corresponding sodium chloroacetate was used, respectively. The purity of these monomers as determined by HPLC are listed below.

| Monomer No. | Purity |
|---|---|
| (14) | 99% |
| (15) | 98% |
| (16) | 99% |
| (17) | 98% |
| (18) | 97% |

Synthesis of Monomer (19)

Into a 1-liter three-necked flask were charged 50 g of 4-nitro-phenylaminoacetic acid and 600 ml of 2-propanol. To the mixture were then added 71 g of reduced iron and an aqueous solution of ammonium chloride obtained by dissolving 15.2 g of ammonium chloride in 60 ml of water. The reaction mixture was allowed to undergo reaction at a temperature of 90° C. for 5 hours, extracted with dichloromethane, and then subjected to silica gel chromatography to obtain 29 g of 4-amino-phenylaminoacetic acid.

Subsequently, into a 500 ml three-necked flask were charged 250 ml of water and 29 g of 4-amino-phenylaminoacetic acid thus obtained. To the mixture were then slowly added dropwise 15 g of sodium hydroxide and 35 g of methacryloyl chloride over ice bath. Thereafter, the reaction mixture was allowed to cool to room temperature where it was then stirred for 6 hours. After reaction, concentrated hydrochloric acid was added dropwise to the reaction mixture until the pH value of the solution reached 1. As a result, precipitation of a solid matter was observed. The resulting precipitate was filtered off, and then thoroughly washed with water to obtain a white solid matter. The white solid matter thus obtained was then recrystallized from a mixture of ethanol and water so that it was purified to obtain 31 g of Monomer (19) in the form of white solid matter (purity: 99% as determined by HPLC).

Synthesis of Monomers (20) to (24)

Monomers (20) to (24) were prepared in the same manner as in the synthesis of Monomer (19) except that the corresponding 4-nitro-phenylaminoacetic acid was used, respectively. The purity of these monomers as determined by HPLC are listed below.

| Monomer No. | Purity |
|---|---|
| (20) | 98% |
| (21) | 98% |
| (22) | 99% |
| (23) | 98% |
| (24) | 99% |

Synthesis of Polymer (P-6)

Into a 200 ml three-necked flask were charged 20 g of Monomer (6) and 40 g of dimethylacetamide. To the mixture was then added 0.2 g of 2,2'-azobis(2,4-dimethylvaleronitrile) at a temperature of 65° C. in a stream of nitrogen. The reaction mixture was then stirred at the same temperature for 6 hours. Thereafter, the reaction mixture was allowed to cool to room temperature where it was then subjected to reprecipitation in 1 liter of water to obtain a polymer solid. The polymer was found to have a weight-average molecular weight of 12,000 as determined by GPC.

Synthesis of Polymers (P-1) to (P-5), and (P-7) to (P-24)

Polymers (P-1) to (P-5) and (P-7) to (P-24) were prepared in the same manner as in the synthesis of Polymer (P-6) except that Monomer (6) was replaced by the monomers set forth in Table 1, respectively. The weight-average molecular weight of Polymers (P-1) to (P-5) and (P-7) to (P-24) thus prepared are set forth in Table 1.

TABLE 1

| Monomer structure | Polymer structure | Weight-average molecular weight (× 10,000) |
|---|---|---|
| 1 | P-1 | 1.04 |
| 2 | P-2 | 1.11 |
| 3 | P-3 | 1.23 |
| 4 | P-4 | 1.59 |
| 5 | P-5 | 1.42 |
| 7 | P-7 | 0.89 |
| 8 | P-8 | 1.11 |
| 9 | P-9 | 1.65 |
| 10 | P-10 | 1.47 |
| 11 | P-11 | 1.58 |
| 12 | P-12 | 1.00 |
| 13 | P-13 | 1.02 |
| 14 | P-14 | 1.05 |
| 15 | P-15 | 1.33 |
| 16 | P-16 | 1.41 |
| 17 | P-17 | 1.23 |
| 18 | P-18 | 1.00 |
| 19 | P-19 | 1.02 |
| 20 | P-20 | 0.89 |
| 21 | P-21 | 0.99 |
| 22 | P-22 | 0.85 |
| 23 | P-23 | 1.25 |
| 24 | P-24 | 1.12 |

Synthesis of Polymer (P-25)

To a mixture of 10 g of Polymer (P-1) and 44 ml of methanol was slowly added dropwise 8.5 g of sodium methoxide (28% methanol solution) over ice bath. The reaction mixture was then stirred for 5 minutes. The resulting solid matter was filtered off, and then dried to obtain 9.1 g of Polymer (P-25).

Synthesis of Polymers (P-26) to (P-42)

Polymers (P-26) to (P-42) were prepared in the same manner as in synthesis of Polymer (P-25) except that Polymer (P-1) and sodium methoxide were replaced by the polymers and bases in Table 2 below.

TABLE 2

| Synthetic polymer | Polymer used in synthesis | Base |
|---|---|---|
| P-26 | P-2 | Potassium methoxide |
| P-27 | P-1 | Tetramethylammonium hydroxide |
| P-28 | P-1 | Tetrabutylammonium hydroxide |
| P-29 | P-5 | Sodium methoxide |
| P-30 | P-5 | Tetramethylammonium hydroxide |
| P-31 | P-6 | Sodium methoxide |
| P-32 | P-6 | Potassium methoxide |
| P-33 | P-6 | Tetramethylammonium hydroxide |
| P-34 | P-6 | Tetraethylammonium hydroxide |
| P-35 | P-6 | Tetraphenylammonium hydroxide |
| P-36 | P-7 | Sodium methoxide |
| P-37 | P-15 | Potassium methoxide |

TABLE 2-continued

| Synthetic polymer | Polymer used in synthesis | Base |
|---|---|---|
| P-38 | P-16 | Tetramethylammonium hydroxide |
| P-39 | P-17 | Tetraethylammonium hydroxide |
| P-40 | P-18 | Tetrabutylammonium hydroxide |
| P-41 | P-19 | Tetraphenylammonium hydroxide |
| P-42 | P-20 | Sodium methoxide |

Synthesis of Polymer (P-43)

Into a 200 ml three-necked flask were charged 20 g of Monomer (1), 2.6 g of 2-hydroxyethyl acrylate and 45.2 g of water. To the mixture was then added 0.33 g of 2,2'-azobis (2,4-dimethylvaleronitrile) at a temperature of 65° C. in a stream of nitrogen. The reaction mixture was then stirred at the same temperature for 6 hours. Thereafter, the reaction mixture was allowed to cool to room temperature where it was then subjected to reprecipitation in 1 liter of water to obtain a polymer solid. The polymer was found to have a weight-average molecular weight of 13,700 as determined by GPC.

Synthesis of Polymers (P-44) to (P-49)

Polymers (P-44) to (P-49) were prepared in the same manner as in the synthesis of Polymer (P-43) except that the monomers set forth in Table 3 below were used, respectively. The weight-average molecular weight of Polymers (P-44) to (P-49) prepared are set forth in Table 3 below.

TABLE 3

| Monomer No. | Monomer | Polymer structure | Weight-average molecular weight |
|---|---|---|---|
| 1 | Methyl acrylate | P-44 | 1.10 |
| 5 | 2-Hydroxyethyl methacrylate | P-45 | 1.04 |
| 5 | Ethyl acrylate | P-46 | 0.98 |
| 6 | 2-Hydroxyethyl methacrylate | P-47 | 1.54 |
| 6 | Methyl methacrylate | P-48 | 1.11 |
| 6 | Ethyl methacrylate | P-49 | 1.25 |

Synthesis of Polymers (P-50) to (P-57)

Polymers (P-50) to (P-57) were prepared in the same manner as in the synthesis of Polymer (P-25) except that Polymer (P-1) and sodium methoxide were replaced by the polymers and bases set forth in Table 4 below.

TABLE 4

| Synthetic polymer | Polymer used in synthesis | Base |
|---|---|---|
| P-50 | P-43 | Sodium methoxide |
| P-51 | P-44 | Tetramethylammonium hydroxide |
| P-52 | P-47 | Sodium methoxide |
| P-53 | P-47 | Tetramethylammonium hydroxide |
| P-54 | P-48 | Sodium methoxide |
| P-55 | P-48 | Tetramethylammonium hydroxide |
| P-56 | P-49 | Sodium methoxide |
| P-57 | P-49 | Tetramethylammonium hydroxide |

The photothermal converter usable in the invention has no particular restriction as far as it can absorb radiation of light energy used for recording. In making a printing plate by the use of infrared laser, which is a preferred mode for carrying out the invention, it is desirable to use an infrared absorber as the photothermal converter. Suitable examples of an infrared absorber are illustrated below:

[Infrared Absorber]

In applying the lithographic printing plate of the present invention to the image formation by infrared irradiation (heat mode exposure) as a lithographic printing plate precursor, an infrared absorber is incorporated into a recording layer of the lithographic printing plate.

The infrared absorbers used to advantage in the invention are dyes or pigments effectively absorbing infrared rays of wavelengths ranging from 760 nm to 1,200 nm. In particular, the dyes and pigments having their absorption maxima in the wavelength range of 760 to 1,200 nm are preferable.

As these dyes, commercially available dyes and dyes known in literature (e.g., *Senryo Binran* (which means *"Handbook of Dyes"*), compiled by Yuki Gousei Kagaku Kyokai, published in 1970) can be employed. Examples thereof include azo dyes, metal complex azo dyes, pyrazolone azo dyes, anthraquinone dyes, phthalocyanine dyes, carbonium dyes, quinoneimine dyes, methine dyes, cyanine dyes and metal thiolate complexes.

More specifically, the cyanine dyes disclosed in, e.g., JP-A-58-125246, JP-A-59-84356, JP-A-59-202829 and JP-A-60-78787, the methine dyes disclosed in, e.g., JP-A-58-173696, JP-A-58-181690 and JP-A-58-194595, the naphthoquinone dyes disclosed in, e.g., JP-A-58-112793, JP-A-58-224793, JP-A-59-48187, JP-A-59-73996, JP-A-60-52940 and JP-A-60-63744, the squarylium dyes disclosed in, e.g., JP-A-58-112792 and the cyanine dyes disclosed in British Patent 434,875 can be used as desirable dyes.

Further, the use of the near infrared absorption sensitizers disclosed in U.S. Pat. No. 5,156,938 is also well suited. In addition, the substituted arylbenzo(thio)-pyrylium salts disclosed in U.S. Pat. No. 3,881,924, the trimethinethiapyrylium salts disclosed in JP-A-57-142645 (U.S. Pat. No. 4,327,169), the pyrylium compounds disclosed in JP-A-58-181051, JP-A-58-220143, JP-A-59-41363, JP-A-59-84248, JP-A-59-84249, JP-A-59-146063 and JP-A-59-146061, the cyanine dyes disclosed in JP-A-59-216146, the pentamethinethio-pyrylium salts disclosed in U.S. Pat. No. 4,283,475, and the pyrylium compounds disclosed in JP-B-5-13514 and JP-B-5-19702 (the term "JP-B" as used herein means an "examined Japanese patent publication") can also be used to advantage.

As another suitable examples of dyes, mention may be made of the near infrared absorbing dyes defined as formulae (I) and (II) in U.S. Pat. No. 4,756,993.

Of those dyes, the cyanine dyes, the squarylium dyes, the pyrylium dyes and the nickel thiolate complexes are preferred in particular.

As examples of pigments usable in the invention, mention may be made of commercially available pigments and the pigments described in *Colour Index* (*C.I.*) *Handbook, Saishin Ganryo Binran* (which means *"Newest Handbook of Pigments"*), compiled by Nippon Ganryo Gijutu Kyokai, published in 1977, *Saishin Ganryo Ohyo Gijutu* (which means *"Newest Application Arts of Pigments"*), published by CMC Shuppan in 1986, and *Insatu Ink Gijutu* (which means *"Techniques for Printing Ink"),* published by CMC Shuppan in 1984.

As to the type of pigment, black pigments, yellow pigments, orange pigments, brown pigments, red pigments, violet pigments, blue pigments, green pigments, fluorescent pigments, metallic powder pigments and polymer-bonded dyes are examples thereof. Specifically, the usable pigments include insoluble azo pigments, azo lake pigments, condensed azo pigments, chelate azo pigments, phthalocyanine pigments, anthraquinone pigments, perylene and perynone pigments, thioindigo pigments, quinacridone pigments, dioxazine pigments, isoindolinone pigments, quinophthalone pigments, dyed lake pigments, azine pigments, nitroso pigments, nitro pigments, natural pigments, fluorescent pigments, inorganic pigments and carbon black. Of these pigments, carbon black is preferred over the others.

These pigments may be used without surface treatment, but they may be used after undergoing surface treatment. Examples of a surface treatment method include the method of coating resin or wax on the pigment surface, the method of making a surfactant adhere to the pigment surface, and the method of making a reactive substance (e.g., a silane coupling agent, an epoxy compound, polyisocyanate) fuse with the pigment surface. These surface treatment methods are described in Kinzoku Sekken no Seishitu to Ohyo (which means "Properties of Metallic Soap and Application thereof"), published by Sachi Shobo, *Insatu Ink Gijutu* (which means *"Techniques for Printing Ink"*), published by CMC Shuppan in 1984, and *Saishin Ganryo Ohyo Gijutu* (which means *"Newest Application Arts of Pigments"*), published by CMC Shuppan in 1986.

For the grain size, it is desirable to be in the range of 0.01 to 10 $\mu$m, preferably 0.05 to 1 $\mu$m, particularly preferably 0.1 to 1 $\mu$m. When the grain size of a pigment is smaller than 0.01 $\mu$m, the resulting pigment dispersion is undesirable from the viewpoint of the stability in the coating solution of a photosensitive composition; while, when the pigment grain size is greater than 10 $\mu$m, the image recording layer formed by coating is inferior in uniformity.

In dispersing pigment grains, conventional dispersing techniques used for ink production or toner production can be adopted. Examples of a dispersing machine usable therein include an ultrasonic disperser, a sand mill, an attriter, a pearl mill, a super mill, a ball mill, an impeller, a disperser, a KD mill, a colloid mill, a Dynatron, a three-rod roll mill and a pressurized kneader. Details thereof are described in *Saishin Ganryo Ohyo Gijutu* (which means *"Newest Application Arts of Pigments"*), published by CMC Shuppan in 1986.

Those dyes and pigments are incorporated in a proportion of 0.01 to 50 weight %, preferably 0.1 to 10 weight %, particularly preferably 0.5 to 10 weight % in the case of dyes and 1.0 to 10 weight % in the case of pigments, to the total solids in the composition for forming the recording layer of a lithographic printing plate. When the proportion of dye(s) or pigment(s) incorporated is lower than 0.01 weight %, the sensitivity becomes low; while, when it is increased beyond 50 weight %, scum tends to develop in the non-imaging area upon printing.

To the recording layer of the present lithographic printing plate, the nonionic surfactants as disclosed in JP-A-62-251740 and JP-A-3-208514 and the amphoteric surfactants as disclosed in JP-A-59-121044 and JP-A-4-13149 can be added for the purpose of improving the stability to variation of printing conditions.

Examples of a nonionic surfactant include sorbitan tristearate, sorbitan monopalmitate, sorbitan trioleate, stearic acid monoglyceride and polyoxyethylene nonyl phenyl ether.

Examples of an amphoteric surfactant include alkyldi(aminoethyl)glycines, alkylpolyaminoethylglycine hydrochlorides, 2-alkyl-N-carboxyethyl-N-hydroxyethylimidazolium betaines and N-tetradecyl-N,N-betaine (e.g., Amorgen K, trade name, produced by Daiichi Seiyaku Co., Ltd.)

The proportion of such nonionic and amphoteric surfactants in the total solids of the image forming material is from 0.05 to 15 weight %, preferably from 0.1 to 5 weight %.

To the recording layer of the present lithographic printing plate, if needed, plasticizers can further be added for conferring pliability on the coated layer. Examples of a plasticizer usable for such a purpose include polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and acrylic or methacrylic acid oligomer and polymer.

The recording layer of the present lithographic printing plate can be generally formed by dissolving the foregoing ingredients in a solvent and coating the solution on an appropriate support. Examples of a solvent usable therein include ethylene dichloride, cyclohexanone, methyl ethyl ketone, methanol, ethanol, propanol, ethylene glycol monomethyl ether, 1-methoxy-2-propanol, 2-methoxyethylacetate, 1-methoxy-2-propylacetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, γ-butyrolactone, toluene and water. However, these examples should not be construed as limiting the scope of the invention.

The above-described solvents are used singly or in admixture thereof. The concentration of the above-described ingredients (total solids content including additives) in the solvent is preferably from 1 to 50% by weight. The coating amount (solids content) coated on the support obtained after coating or drying is preferably from 0.5 to 5.0 g/m$^2$. As the coating method, various coating methods such as bar coating, rotary coating, spray coating, curtain coating, dip coating, air knife coating, blade coating, and roll coating, etc.

In the recording layer of the present lithographic printing plate, a surfactant for improving coating property, for example a fluorinated surfactant as disclosed in JP-A-62-170950, may be used. The amount added is preferably from 0.01 to 1% by weight, more preferably from 0.05 to 0.5% by weight, based on the total solids content in the photosensitive layer of the photosensitive lithographic printing plate.

The support (substrate) which is coated with the present image forming material (recording layer) to provide a lithographic printing plate precursor is a dimensionally stable sheet-form material, including all materials which have hitherto been used as support for printing plate. Suitable examples of such a material include paper, paper laminated with plastic (e.g., polyethylene, polypropylene, polystyrene), a metal sheet such as a sheet of aluminum (including aluminum alloys), zinc, iron or copper, a plastic film such as a film of cellulose diacetate, cellulose triacetate, cellulose propionate, cellulose butyrate, cellulose acetobutyrate, cellulose nitrate, polyethylene terephthalate, polyethylene, polystyrene, polypropylene, polycarbonate or polyvinyl acetal, and paper or a plastic film on which the metal as recited above is laminated or deposited. Of these materials, the aluminum sheets, including aluminum alloy sheets as well as a pure aluminum sheet, are preferred over the others. As to the aluminum alloys, various alloys of aluminum and other metals, such as silicon, copper, manganese, magnesium, chromium, zinc, lead, bismuth and nickel, can be employed. In these compositions, some quantities of iron and titanium or negligible quantities of other impurities are further contained.

The support is subjected to a surface treatment, e.g., a treatment for conferring water wettability on the support surface, if needed.

When the support has a metal surface, especially an aluminum surface, it is desirable for the support to undergo a surface treatment, such as a graining treatment, an immersion treatment in an aqueous solution of sodium silicate, potassium fluorozirconate or phosphate, or an anodic oxidation treatment. Further, it is also favorable to use the aluminum sheet subjected to a graining treatment and then to an immersion treatment in an aqueous solution of sodium silicate, as disclosed in U.S. Pat. No. 2,714,066, or the aluminum sheet subjected to an anodic oxidation treatment and then to an immersion treatment in an aqueous solution of alkali metal silicate, as disclosed in U.S. Pat. No. 3,181,461. The anodic oxidation treatment can be effected by sinking an aluminum sheet as anode into an electrolyte and passing current therethrough. As to the electrolyte, aqueous or non-aqueous solutions of inorganic acids, such as phosphoric acid, chromic acid, sulfuric acid and boric acid, organic acids, such as oxalic acid and sulfaminic acid, or salts thereof can be used alone or as combination of two or more thereof.

In addition, as disclosed in U.S. Pat. No. 3,658,682, it is also effective to carry out the electrodeposition of silicate.

Besides rendering the support surface wettable with water, those water-wettability providing treatments are performed for prevention of a harmful reaction between support surface and the recording layer and elevation of adhesiveness to the recording layer.

Prior to the graining treatment, the aluminum sheet may undergo pre-treatments for removing the rolling oil from the sheet surface and making the sheet surface clean, if desired. For the former pre-treatment, a solvent, such as trichlene, and a surfactant are used; while, for the latter pre-treatment, the use of an alkali etching agent, such as sodium hydroxide or potassium hydroxide, is prevailing.

In graining the metal surface, any of mechanical, chemical and electrochemical methods can be adopted effectively. Examples of a mechanical graining method include a ball abrasion method, a blast abrasion method and a brush abrasion method wherein the slurry as aqueous dispersion of abrasive, such as pumice, is rubbed with a nylon brush. As to the chemical graining method, the method of immersing in a saturated water solution of aluminum salt of mineral acid is advantageous. As an electrochemical graining method, the method of performing AC electrolysis in an acidic electrolyte, such as hydrochloric acid, nitric acid or a mixture thereof, is favorably adopted. Of those surface roughening methods, the combined use of mechanical and electrochemical roughening methods as disclosed in JP-A-55-137993 is preferable, because it can ensure strong adhesiveness of the support to ink-receptive images.

It is desirable that the graining treatment according to any of the above-cited methods be performed so that the aluminum sheet surface has a center line average roughness (Ra) in the range of 0.3 to 1.0 $\mu$m.

The thus grained aluminum sheet is washed and chemically etched, if needed.

The etching treatment solution is generally selected from aqueous solutions of bases or acids capable of dissolving aluminum. For this treatment, however, it is necessary that no film, excepting an aluminum film, be formed from the etching component on the etched surface. As examples of a suitable base for etching agent, mention may be made of sodium hydroxide, potassium hydroxide, trisodium phosphate, disodium phosphate, tripotassium phosphate and dipotassium phosphate. As examples of a suitable acid as etching agent, mention may be made of sulfuric acid, persulfuric acid, phosphoric acid, hydrochloric acid and salts thereof. On the other hand, the salts of metals having weaker tendency to ionization than aluminum, e.g., the salts of zinc, chromium, cobalt, nickel and copper, are unsuitable for etching component, because they form an unnecessary film on the etched surface.

In performing the etching treatment, it is most desirable to control the etching agent concentration and the etching temperature so that the dissolution rate of the aluminum or alloy used is from 0.3 to 40 g/m$^2$ per minute of immersion time. However, the dissolution rates above or below the foregoing limits may be all right.

The etching treatment is carried out by immersing an aluminum sheet in an etching solution or applying an etching solution to an aluminum sheet. Therein, it is desirable that the amount etched be controlled to the range of 0.5 to 10 g/m$^2$.

As to the etching agent, aqueous solutions of bases are preferred because of their high etching speeds. However, these solutions generate smut, so that a desmutting treatment is usually carried out. For the desmutting treatment, acids such as nitric acid, sulfuric acid, phosphoric acid, chromic acid, hydrogen fluoride and hydrogen borofluoride can be employed.

The etched aluminum sheet is subjected to washing and anodic oxidation treatments, if needed. The anodic oxidation can be effected by conventional methods. Specifically, DC or AC current is sent into an aluminum sheet immersed in an aqueous or non-aqueous solution of sulfuric acid, phosphoric acid, chromic acid, oxalic acid, sulfaminic acid, benzenesulfonic acid or a mixture of two or more thereof, and thereby a film is formed anodically on the aluminum sheet surface.

The conditions for anodic oxidation treatment change variously depending on the electrolyte used, so they cannot be generalized. However, by the normal standards of anodic oxidation, it would be appropriate that the electrolyte concentration be from 1 to 30 weight %, the electrolyte temperature be from 5 to 70° C., the current density be from 0.5 to 60 ampere/dm$^2$, the voltage be from 1 to 100 V and the electrolysis time be 30 seconds to 50 minutes.

Of those anodic oxidation treatments, the method of performing anodic oxidation in sulfuric acid under a high current density, which is disclosed in U.K. Patent 1,412,768, and the method of using phosphoric acid as an electrolytic bath for anodic oxidation, which is disclosed in U.S. Pat. No. 3,511,661, are preferred over the others.

The surface-roughened and anodically oxidized aluminum sheet may be subjected to water-wettablity providing treatment, if desired. In a suitable method for such a treatment, the alkali metal silicates, such as sodium silicate, disclosed in U.S. Pat. Nos. 2,714,066 and 3,181,461, the potassium fluorozirconate disclosed in JP-A-36-22063 or the polyvinyl phosphonate disclosed in U.S. Pat. No. 4,153,461 is used as treatment agent.

In making the present lithographic printing plate, it is desirable to provide an organic subbing layer before coating the recording layer from the viewpoint of lessening the residue in the non-imaging area of photosensitive layer. The organic compounds used for the organic subbing layer can be selected from, e.g., carboxymethyl cellulose, dextrin, gum arabic, amino group-containing phosphonic acids such as 2-aminoethylphosphonic acid, organic phosphonic acids which may be substituted, such as phenylphosphonic acid, naphthylphosphonic acid, alkyl-phosphonic acids, glycerophosphonic acid, methylene-diphosphonic acid and ethylenediphosphonic acid, organic phosphoric acids which may be substituted, such as phenylphosphoric acid, naphthylphosphoric acid, alkyl-phosphoric acids and glycerophosphoric acid, organic phosphinic acids which may be substituted, such as phenylphosphinic acid, naphthylphosphinic acid, alkyl-phosphinic acids and glycerophosphinic acid, amino acids, such as glycine and β-alanine, or hydroxyl group-containing amine hydrochlorides such as ethanolamine hydrochloride. These compounds may be used alone or as a mixture of two or more thereof.

Besides the compounds recited above, high molecular compounds having poly(p-vinylbenzoate) as constitutional repeating units can be used.

Such an organic subbing layer can be provided in the manners described below: In one manner, the organic compound is dissolved in water, an organic solvent, such as methanol, ethanol or methyl ethyl ketone, or a mixture thereof, coated on the aluminum sheet, and then dried; and, in another manner, the aluminum sheet is immersed into a solution of organic compound in water, an organic solvent, such as methanol, ethanol or methyl ethyl ketone, or a mixture thereof, thereby adsorbing the organic compound onto the aluminum sheet, and then washed with, e.g., water, followed by drying. More specifically, the organic compound solution used in the former manner ranges in concentration from 0.005 to 10 weight %, and it may be coated using any of conventional methods, including a bar coater method, a spin coating method, a spray coating method or a curtain coating method may be used. On the other hand, the solution concentration suitable for the latter manner is from 0.01 to 20 weight %, preferably from 0.05 to 5 weight %, the immersion temperature is from 20 to 90° C., preferably from 25 to 50° and the immersion time is from 0.1 second to 20 minutes, preferably from 2 seconds to 1 minutes.

The solution used therein can be adjusted to the pH range of 1–12 by the use of a basic substance such as ammonia, triethylamine or potassium hydroxide, or an acidic substance such as hydrochloric acid or phosphoric acid. In addition, yellow dyes can further be added to the solution with the intention of improving the tone reproduction of the lithographic printing plate precursor.

The suitable dry coverage of the organic subbing layer is from 2 to 200 mg/m$^2$, preferably from 5 to 100 mg/m$^2$. The dry coverage smaller than 2 mg/m$^2$ cannot ensure sufficient press life for the lithographic printing plate. In addition, one cannot ensure a dry coverage greater than 200 mg/m$^2$.

On the back of the support, a backcoat is provided, if needed. Examples of a coating material suitable for the backcoat include the organic high molecular compounds disclosed in JP-A-5-45885 and the metal oxides produced by hydrolysis or polycondensation of organic or inorganic metal compounds disclosed in JP-A-6-35174.

In particular, the metal oxides prepared from alkoxy compounds of silicon, such as $Si(OCH_3)_4$, $Si(OC_2H_5)_4$, $Si(OC_3H_7)_4$ and $Si(OC_4H_9)_4$, are preferred over the others because these compounds are available at low prices and ensure high water wettability in the coatings thereof.

In accordance with the embodiments mentioned above, the lithographic printing plate precursors of the present invention can be prepared. Each lithographic printing plate is subjected directly to imagewise heat-sensitive recording by means of, e.g., a heat recording (thermal) head, or undergoes imagewise exposure by means of a solid or semiconductor laser device emitting infrared rays of wavelengths ranging from 760 to 1,200 nm. After heat-sensitive recording or irradiation with laser beams, the plate is subjected to development with water and, if desired, to gumming, and then loaded in a press, followed by printing operations. In another way, the plate is loaded in a press just after heat-sensitive recording or irradiation with laser beams, and undergoes printing operations. In both ways, however, it is desirable that the heating treatment be carried out after heat-sensitive recording or irradiation with laser beams. As to the conditions appropriate for heat treatment, the treatment time is from 10 seconds to 5 minutes under the temperature of 80–150° C. By this heat treatment, the heat or laser energy required for heat-sensitive or laser-irradiation recording respectively can be reduced.

The lithographic printing plate which has received such a heat treatment is loaded in an offset press or the like after water development or as it is, and undergoes printing operations to provide a great number of prints.

Additionally, in the case of performing heat-sensitive recording on the present lithographic printing plate precursor by means of a thermal head or the like, the infrared absorbers as recited above may not be incorporated in the recording layer.

The thermal head usable therein has no particular restriction. For instance, simple and compact thermal printers for word processor use and thermal facsimile are applicable.

The present invention will be further described in the following examples, but the present invention should not be construed as being limited thereto. (Preparation of support)

A 0.30 mm-thick aluminum plate (quality grade: 1050) was degreased by cleaning with trichloroethylene, grained on the surface thereof using a nylon brush and a 400-mesh pumice stone-water suspension, and washed thoroughly with water. This plate was etched by 9-second dipping in a 25% aqueous solution of sodium hydroxide kept to 45° C., washed with water, immersed for 20 seconds in 2% $HNO_3$, and further washed with water. Therein, the etched amount at the grained surface was about 3 g/m$^2$. Further, this aluminum plate was immersed in 7% $H_2SO_4$ as electrolyte and anodically oxidized with DC current density of 15 A/dm$^2$ to form an anodic oxidation film of 3 g/m$^2$. The thus treated aluminum sheet was washed with water and dried.

EXAMPLES 1 TO 5

Five kinds of solutions, (A-1) to (A-5), were prepared so as to have the following Composition (A), wherein the present polymer having carboxylic acid or carboxylate groups was changed as shown in Table 5. These solutions were each applied to the aluminum sheet prepared above, and dried for 2 minutes at 100° C. Thus, lithographic printing plate precursors, (A-1) to (A-5), were prepared. The weight of each plate after drying was 1.1 g/m$^2$.

| Composition (A) | |
|---|---|
| Polymer having carboxylic acid groups (Table 5) | 1.0 g |
| Infrared absorber NK-3508 (made by Nippon Kanko Shikiso Kenkyujo K.K.) | 0.15 g |
| Megafac F-177 (fluorine-containing surfactant, made by Dainippon Ink and Chemicals Inc.) | 0.06 g |
| Methyl ethyl ketone | 20 g |
| Methyl alcohol | 7 g |

The lithographic printing plate precursors (A-1) to (A-5) thus obtained were each exposed by means of a semiconductor laser device emitting the infrared beam of 830 nm, and loaded in a Hidel KOR-D printing machine without undergoing development. The fountain solution used therein will be described below.

Fountain solution: pH 8.8 ($H_2O$: 84.7%; IPA: 10%; Triethylamine: 5%,; Concentrated hydrochloric acid: 0.3%)

After printing, the image areas of prints were evaluated as to whether or not they had sufficient inking. The inking quality during the printing operations was examined at the stages of obtaining 1,000 sheets of prints and 20,000 sheets of prints respectively. The results obtained are shown in Table 5. In every case, prints of good inking quality were obtained.

Comparative Examples 1

A lithographic printing plate precursor (C-1) was prepared in the same manner as in Examples 1 to 5, except that the present polymer having carboxylic acid or carboxylate groups was replaced by polyacrylic acid. This plate underwent plate-making processing and printing operations under the same conditions as in Examples 1 to 5. The results obtained are also shown in Table 5. No prints were obtained because bad inking of the imaging area.

EXAMPLES 6 TO 10

Five kinds of solutions, (B-1) to (B-5), were prepared so as to have the following Composition (B), wherein the present polymer having carboxylic acid or carboxylate groups was changed as shown in Table 5. These solutions were each applied to the aluminum sheet prepared above, and dried for 2 minutes at 100° C. Thus, lithographic printing plate precursors, (B-1) to (B-5), were prepared. The weight of each plate after drying was 1.1 g/m$^2$.

| Composition (B) | |
|---|---|
| Polymer having carboxylic acid groups (Table 5) | 1.0 g |
| Himicron K Black (made by Mikuni Color Ltd.) | 0.30 g |
| Water | 18 g |
| Acetonitrile | 9 g |

The lithographic printing plate precursors (B-1) to (B-5) thus obtained were each exposed by means of a semiconductor laser device emitting the infrared beam of 830 nm, and loaded in a Hidel KOR-D printing machine without undergoing development. As the fountain solution therein there was used tap water.

After printing, the image areas of prints were evaluated as to whether or not they had sufficient inking. The inking quality during the printing operations was examined at the stages of obtaining 1,000 sheets of prints and 20,000 sheets of prints respectively. The results obtained are shown in Table 5. In every case, prints of good inking quality were obtained.

Comparative Example 2

A lithographic printing plate precursor (C-2) was prepared in the same manner as in Examples 6 to 10, except that the present polymer having carboxylic acid or carboxylate groups was replaced by sodium polyacrylate. This plate underwent plate-making processing and printing operations under the same conditions as in Examples 6 to 10. The results obtained are also shown in Table 5. No prints were obtained because bad inking of the imaging area.

TABLE 5

| | Lithographic printing plate precursor | Polymer having carboxylic acid or carboxylate groups | Inking of imaging area upon printing: 1000th print | Inking of imaging area upon printing: 20000th print |
|---|---|---|---|---|
| Example 1 | (A-1) | P-1 | good | good |
| Example 2 | (A-2) | P-6 | good | good |
| Example 3 | (A-3) | P-7 | good | good |
| Example 4 | (A-4) | P-47 | good | good |
| Example 5 | (A-5) | P-48 | good | good |
| Example 6 | (B-1) | P-25 | good | good |
| Example 7 | (B-2) | P-31 | good | good |

TABLE 5-continued

| | Lithographic printing plate precursor | Polymer having carboxylic acid or carboxylate groups | Inking of imaging area upon printing: 1000th print | Inking of imaging area upon printing: 20000th print |
|---|---|---|---|---|
| Example 8 | (B-3) | P-33 | good | good |
| Example 9 | (B-4) | P-35 | good | good |
| Example 10 | (B-5) | P-52 | good | good |
| Comparative Example 1 | (C-1) | Polyacrylic acid | No prints were obtained | No prints were obtained |
| Comparative Example 2 | (C-2) | Sodium polyacrylate | No prints were obtained | No prints were obtained |

EXAMPLES 11 TO 13

Three kinds of solutions, (A-6) to (A-8), were prepared in the same manner as in the preparation of Composition (A), except that the present polymer having carboxylic acid or carboxylate groups in Composition (A) was changed as set forth in Table 6. Each of these solutions was applied to the same surface-treated aluminum sheet as used in Examples 1 to 5, and then dried for 2 minutes at 100° C. Thus, lithographic printing plate precursors, (A-6) to (A-8), were prepared. The weight of each plate after drying was 1.2 g/m$^2$.

Each of the lithographic printing plate precursors (A-6) to (A-8) was exposed using a semiconductor laser device emitting the infrared ray with wavelength of 830 nm under the condition that the output was kept constant but the scanning speed was changed. Additionally, the total output applied to the plate surface in this exposure step was 169 mW and the beam diameter (1/e$^2$) was 12 $\mu$m. Before and after exposure, the contact angle of a water drop made with the surface of each plate in the air was measured. The water drop used therein had the pH value of 8.8, and was constituted of 84.7% of water, 10% of IPA, 5% of triethylamine and 0.3% of concentrated hydrochloric acid. The results obtained are shown in Table 7. As can be seen from Table 7, even when the scanning speed was increased, the contact angle represented an increase over that before exposure. In other words, the data shows that a discrimination between water-receptive and ink-receptive areas can be made even when the exposure energy is small.

EXAMPLES 14 TO 16

Three kinds of solutions were prepared so as to have the foregoing Composition (B), wherein the present polymer having carboxylic acid or carboxylate groups in Composition (B) was changed as shown in Table 6 respectively. Each of these solutions was applied to the same surface-treated aluminum sheet as mentioned above, and then dried for 2 minutes at 100° C. Thus, lithographic printing plate precursors, (B-6) to (B-8), were prepared. The weight of each plate after drying was 1.2 g/m$^2$.

Each of the lithographic printing plate precursors (B-6) to (B-8) was exposed using a semiconductor laser device emitting the infrared ray with wavelength of 830 nm under the condition that the output was kept constant but the scanning speed was changed. Additionally, the total output applied to the plate surface in this exposure step was 169 mW and the beam diameter (1/e$^2$) was 12 $\mu$m. Before and after exposure, the contact angle of a water drop made with the surface of each plate in the air was measured. The water drop used therein was tap water. The results obtained are shown in Table 7. As can be seen from Table 7, even when the scanning speed was increased, the contact angle represented an increase over that before exposure. In other words, the data shows that a discrimination between water-receptive and ink-receptive areas can be made even when the exposure energy is small.

TABLE 6

| | Lithographic printing plate precursor | Polymer containing carboxylic acid or carboxylate groups |
|---|---|---|
| Example 11 | (A-6) | P-6 |
| Example 12 | (A-7) | P-19 |
| Example 13 | (A-8) | P-49 |
| Example 14 | (B-6) | P-31 |
| Example 15 | (B-7) | P-34 |
| Example 16 | (B-8) | P-56 |

TABLE 7

| | Contact angle of a water drop in the air | | | |
|---|---|---|---|---|
| | Before exposure | Scanning speed of 1.1 m/s | Scanning speed of 2.5 m/s | Scanning speed of 4.4 m/s |
| Example 11 | spread wetting | 75° | 73° | 72° |
| Example 12 | spread wetting | 79° | 79° | 77° |
| Example 13 | spread wetting | 78° | 75° | 74° |
| Example 14 | spread wetting | 79° | 79° | 77° |
| Example 15 | spread wetting | 73° | 72° | 69° |
| Example 16 | spread wetting | 70° | 69° | 68° |

EXAMPLES 17 TO 19

Three kinds of solutions, (A-9) to (A-11), were prepared so as to have the foregoing Composition (A), wherein the present polymer having carboxylic acid or carboxylate groups was changed as shown in Table 8. These solutions were each applied to the aluminum sheet prepared above, and dried for 2 minutes at 100° C. Thus, lithographic printing plate precursors, (A-9) to (A-11), were prepared The weight of each plate after drying was 1.2 g/m$^2$.

After storage for 3 days under the high temperature-humidity condition of 40° C.-70% RH, the lithographic printing plate precursors (A-9) to (A-11) thus obtained were each exposed by means of a semiconductor laser device emitting the infrared beam of 830 nm, and loaded in a Hidel KOR-D printing machine without undergoing development. The fountain solution used therein will be described below.

Fountain solution: pH 8.8 ($H_2O$: 84.7%; IPA: 10%; Triethylamine: 5%; Concentrated hydrochloric acid: 0.3%)

After printing, the non-image areas of prints were examined for scumming. The scumming properties in the non-imaging area during the printing operations were evaluated by the scums on the 1,000th print and 20,000th print. The results obtained are shown in Table 8. In every case, prints of good inking quality on the imaging area were obtained.

EXAMPLES 20 To 22

Three kinds of solutions, (B-9) to (B-11), were prepared so as to have the foregoing Composition (B), wherein the present polymer having carboxylic acid or carboxylate groups was changed as shown in Table 8. These solutions were each applied to the aluminum sheet prepared above, and dried for 2 minutes at 100° C. Thus, lithographic printing plate precursors, (B-9)to (B-11), were prepared. The weight of each plate after drying was 1.2 g/m$^2$.

After storage for 3 days under the high temperature-humidity condition of 40° C.–70% RH, the lithographic printing plate precursors (B-9) to (B-11) thus obtained were each exposed by means of a semiconductor laser device emitting the infrared beam of 830 nm, and loaded in a Hidel KOR-D printing machine without undergoing development. As the fountain solution there was used tap water.

After printing, the non-image areas of prints were examined for scumming. The scuming properties in the non-imaging area during the printing operations were evaluated by the scums on the 1,000th print and 20,000th print. The results obtained are shown in Table 8. In every case, prints of good inking quality on the imaging area were obtained.

TABLE 8

| | Lithographic printing plate precursor | Polymer having carboxylic acid or carboxylate groups | Scumming in non-imaging area during printing | |
|---|---|---|---|---|
| | | | 1,000th print | 20,000th print |
| Example 17 | (A-9) | P-5 | no scum | no scum |
| Example 18 | (A-10) | P-13 | no scum | no scum |
| Example 19 | (A-11) | P-45 | no scum | no scum |
| Example 20 | (B-9) | P-29 | no scum | no scum |
| Example 21 | (B-10) | P-30 | no scum | no scum |
| Example 22 | (B-11) | P-39 | no scum | no scum |

EXAMPLES 23 TO 25

Three kinds of solutions, (D-1) to (D-3), were prepared so as to have the following Composition (D), wherein the present polymer having carboxylic acid or carboxylate groups in Composition (B) was changed as shown in Table 9 respectively. Each of these solutions was applied to the same surface-treated aluminum sheet as mentioned above, and then dried for 2 minutes at 100° C. Thus, lithographic printing plate precursors, (D-1) to (D-3), were prepared. The weight of each plate after drying was 1.1 g/m$^2$.

| Composition (D) | |
|---|---|
| Polymer having carboxylic acid or carboxylate groups (Table 9) | 1.0 g |
| Megafac F-177 (fluorine-containing surfactant, made by Dainippon Ink & Chemicals, Inc.) | 0.06 g |
| Methyl ethyl ketone | 20 g |
| Methyl alcohol | 7 g |

The typing was carried out on each of the lithographic printing plate precursors (D-1) to (D-3) thus obtained with a thermal head installed in a word processor, Shoin, (trade name, made by Sharp Corporation). The thus made lithographic printing plates were each evaluated using the same printing machine in the same way as in Examples 1 to 5. The results obtained are shown in Table 9. In every case, prints without scumming were obtained even after not only 1,000 sheets but also 20,000 sheets were printed.

Comparative Example 3

A lithographic printing plate (C-3) was prepared in the same manner as in Examples 23 to 25, except that the present polymer having carboxylic acid or carboxylate groups was replaced by polyacrylic acid. This plate underwent plate-making processing and printing operations under the same conditions as in Examples 23 to 25. The results obtained are also shown in Table 9.

EXAMPLES 26 TO 28

Three kinds of solutions, (E-1) to (E-3), were prepared so as to have the following Composition (E), wherein the present polymer having carboxylic acid or carboxylate groups in Composition (E) was changed as shown in Table 9 respectively. Each of these solutions was applied to the same surface-treated aluminum sheet as mentioned above, and then dried for 2 minutes at 100° C. Thus, lithographic printing plate precursors, (E-1) to (E-3), were prepared. The weight of each plate after drying was 1.1 g/m$^2$.

| Composition (E) | |
|---|---|
| Polymer having carboxylic acid or carboxylate groups (Table 9) | 1.0 g |
| Water | 18 g |
| Acetonitrile | 9 g |

The typing was carried out on each of the lithographic printing plate precursors (E-1) to (E-3) thus obtained with a thermal head installed in a word processor, Shoin, (trade name, made by Sharp Corporation). The thus made lithographic printing plates were each evaluated using the same printing machine in the same way as in Examples 6 to 10. The results obtained are shown in Table 9. In every case, prints without scumming were obtained even after not only 1,000 sheets but also 20,000 sheets were printed.

Comparative Example 4

A lithographic printing plate (C-4) was prepared in the same manner as in Examples 26 to 28, except that the present polymer having carboxylic acid or carboxylate groups was replaced by sodium polyacrylate. This plate underwent plate-making processing and printing operations under the same conditions as in Examples 26 to 28. The results obtained are also shown in Table 9.

TABLE 9

| | Lithographic printing plate precursor | Polymer having carboxylic acid or carboxylate groups | Inking of imaging area upon printing 1,000th print | 20,0000th print |
|---|---|---|---|---|
| Example 23 | (D-1) | P-2 | good | good |
| Example 24 | (D-2) | P-7 | good | good |
| Example 25 | (D-3) | P-47 | good | good |
| Example 26 | (E-1) | P-25 | good | good |

TABLE 9-continued

| | Lithographic printing plate precursor | Polymer having carboxylic acid or carboxylate groups | Inking of imaging area upon printing 1,000th print | 20,0000th print |
|---|---|---|---|---|
| Example 27 | (E-2) | P-34 | good | good |
| Example 28 | (E-3) | P-45 | good | good |
| Comparative Example 3 | (C-3) | Polyacrylic acid | No prints were obtained | No prints were obtained |
| Comparative Example 4 | (C-4) | Sodium polyacrylate | No prints were obtained | No prints were obtained |

As demonstrated above, the present invention can provide a lithographic printing plate precursor and a photopolymer composition which enable the writing by short-duration scanning exposure, namely low-energy heat mode exposure, and the making of lithographic printing plate having excellent imaging area strength and scumming resistance. Further, the invention can provide a lithographic printing plate which does not necessarily require development-processing.

What is claimed is:

1. A photopolymer composition for recording images by exposure to infrared laser beams, said composition comprising a photothermal converter and a thermal decarboxylation-causing polymer that comprises at least either constitutional repeating units represented by the following formula (1) or constitutional repeating units represented by the following formula (2):

(1)

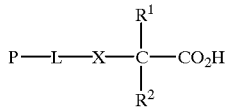

(2)

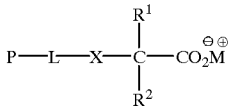

wherein X represents a group 4, 5 or 6 element, an oxide thereof, a sulfide thereof, a selenide thereof or a telluride thereof; P represents a repeating unit constituting the polymer main chain; —L— represents a divalent linkage group; $R^1$ and $R^2$, which are the same or different, each represent a hydrogen atom or a monovalent group; and M represents an alkali metal, an alkaline earth metal or an onium.

* * * * *